US010612789B2

(12) United States Patent
Park et al.

(10) Patent No.: US 10,612,789 B2
(45) Date of Patent: Apr. 7, 2020

(54) OVEN

(71) Applicant: Samsung Electronics Co., Ltd, Suwon-si (KR)

(72) Inventors: Sang Jun Park, Yongin-si (KR); Woo Joo Kim, Suwon-si (KR); Min Ho Yun, Suwon-si (KR); Yeo Wool Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 158 days.

(21) Appl. No.: 15/741,757

(22) PCT Filed: Jul. 1, 2016

(86) PCT No.: PCT/KR2016/007126
§ 371 (c)(1),
(2) Date: Jan. 3, 2018

(87) PCT Pub. No.: WO2017/007188
PCT Pub. Date: Jan. 12, 2017

(65) Prior Publication Data

US 2018/0202665 A1 Jul. 19, 2018

(30) Foreign Application Priority Data

Jul. 3, 2015 (KR) ..... 10-2015-0094976

(51) Int. Cl.
*F24C 15/04* (2006.01)
*F24C 3/12* (2006.01)
*F24C 7/08* (2006.01)

(52) U.S. Cl.
CPC ..... *F24C 3/12* (2013.01); *F24C 7/08* (2013.01); *F24C 7/085* (2013.01); *F24C 15/04* (2013.01); *F24C 15/045* (2013.01)

(58) Field of Classification Search
CPC ..... F24C 15/04
USPC ..... 126/273 R
See application file for complete search history.

(56) References Cited

U.S. PATENT DOCUMENTS

| | | | | |
|---|---|---|---|---|
| 9,982,895 | B2 * | 5/2018 | Ruther | A21B 3/02 |
| 2005/0061958 | A1 | 3/2005 | Baier | |
| 2011/0276289 | A1 * | 11/2011 | Park | G01D 4/00 702/62 |

(Continued)

FOREIGN PATENT DOCUMENTS

| | | | |
|---|---|---|---|
| CN | 1287246 | A | 3/2001 |
| CN | 102413712 | A | 4/2012 |
| DE | 202008000135 | U1 | 3/2008 |

(Continued)

OTHER PUBLICATIONS

Supplementary European Search Report dated Jun. 6, 2018 in connection with European Patent Application No. 16 82 1594.

(Continued)

*Primary Examiner* — Avinash A Savani

(57) ABSTRACT

The oven of the present disclosure includes a monitoring unit for monitoring the cooking room and monitoring the data generated by the monitoring and transmitting the data generated by the monitoring the cooking room to the external device through the network so that the user may not directly check the visible portion of the oven, so that the convenience of the user may be improved.

14 Claims, 38 Drawing Sheets

(56) References Cited

U.S. PATENT DOCUMENTS

2012/0027904 A1 2/2012 Lim

FOREIGN PATENT DOCUMENTS

| | | | |
|---|---|---|---|
| DE | 10 2008 043722 | A1 | 5/2010 |
| EP | 1081436 | A2 | 3/2001 |
| EP | 2515044 | A1 | 10/2012 |
| EP | 2631576 | A2 | 8/2013 |
| JP | H0250028 | A | 2/1990 |
| JP | 2003004366 | A | 1/2003 |
| JP | 2009-140892 | A | 6/2009 |
| KR | 10-2008-0095551 | A | 10/2008 |
| KR | 10-2010-0087627 | A | 8/2010 |
| KR | 10-2010-0122425 | A | 11/2010 |
| KR | 10-2015-0026378 | A | 3/2015 |
| WO | 2009/138359 | A2 | 11/2009 |

OTHER PUBLICATIONS

Communication pursuant to Article 94(3) EPC dated Apr. 25, 2019 in connection with European Patent Application No. 16 821 594.5, 6 pages.

China National Intellectual Property Administration, "The First Office Action," Application No. CN201680049367X, dated Jan. 3, 2019, 18 pages.

International Search Report dated Oct. 13, 2016 in connection with International Patent Application No. PCT/KR2016/007126.

Written Opinion of the International Searching Authority dated Oct. 13, 2016 in connection with International Patent Application No. PCT/KR2016/007126.

China National Intellectual Property Administration, "The Second Office Action," Application No. CN 201680049367.X, dated Jul. 17, 2019, 13 pages.

* cited by examiner

OVEN

CROSS-REFERENCE TO RELATED APPLICATIONS AND CLAIM OF PRIORITY

The present application claims priority under 35 U.S.C. § 365 and is a 371 National Stage of International Application No. PCT/KR2016/007126, filed Jul. 1, 2016, which claims priority to Korean Patent Application No. 10-2015-0094976, filed Jul. 3, 2015, the disclosures of which are fully incorporated herein by reference into the present disclosure as if fully set forth herein.

TECHNICAL FIELD

The present disclosure relates to ovens, and more particularly to a monitoring unit for observing the inside of an oven.

BACKGROUND

Ovens are devices typically equipped with a cooking room, a heating device for applying heat to the cooking room, and a circulation fan for circulating the heat produced by the heating device inside the cooking room to cook food. The ovens are cooking appliances to cook food by sealing up and heating the material, and the ovens may be generally classified by their heat sources into electric, gas, and microwave ovens. The electric oven uses an electric heater as a heat source, and the gas and microwave ovens use heat from gas and frictional heat of water molecules at high frequencies as heat sources, respectively. It is often the case that the user occasionally checks the cooking process to check out the status or add in some spices, and whenever that happens, the user is bothered to go to the oven and look in through the transparent window or open the oven door to check inside. It is also bothersome to have to check the cooking state while the user is cooking other dishes or receiving guests.

SUMMARY

An aspect of the present disclosure is to provide an oven, with which a cooking process may be simply checked out during cooking with the oven. An another aspect of the present disclosure is to provide an oven that effectively supplies power to a monitoring unit of the oven.

In accordance with one aspect of the present disclosure, an oven including a case, a cooking room provided inside the case, a door provided to open or close the cooking room, a monitoring unit provided on the door to monitor the inside of the cooking room, and a cable electrically connected to the monitoring unit, and the cable includes a first cable connected to the monitoring unit at one end and a second cable detachably connected to the other end of the first cable.

And the door is provided to be separable from the case, and the first cable is provided to be separable from the second cable when the door is separated.

And the first cable is arranged on an inner side of the door and the second cable is arranged on an inner side of the case.

And the other end of the first cable extends down from the door to protrude down to the outside of the door.

And the first cable and the second cable are coupled in a region located underneath the door.

The oven further include a storage room provided under the cooking room, and the first cable and the second cable are coupled in a region corresponding to the height of the storage room.

And the storage room is provided to slide against the case, and the first cable and the second cable are separable while the storage room is slid open.

And the first cable and the second cable are coupled in a region exposed to the outside of the oven when the storage room is opened.

And one end of the first cable bores through the door and is coupled to the monitoring unit.

And the other end of the first cable has a first coupler to be detachably coupled to the second cable, and one end of the second cable has a second coupler to be detachably coupled to the first cable.

And the first coupler is located on a USB (Universal Serial Bus) connector and the second coupler is located on a USB port or vice versa.

The oven further include a micom configured to control the camera unit, and the cable electrically connects the micom and the monitoring unit And the other end of the second cable is coupled to the micom.

And the door includes a visible portion made of a transparent material to look inside the cooking room, and the monitoring unit is configured to monitor the cooking room through the visible portion And the monitoring unit is located on an outer side of the visible portion.

And the monitoring unit is configured to monitor the inside of the cooking room and send information resulting from the monitoring to an external device over a network.

In accordance with another aspect of the present disclosure, an oven including a case and a cooking room formed inside the case is provided. The oven includes a monitoring unit configured to monitor the inside of the cooking room and send information resulting from the monitoring to an external device over a network, a micom configured to control the monitoring unit, and a cable electrically connecting the micom and the monitoring unit, wherein the cable includes at least one decoupling portion, in which the cable is separated, in a region where the micom and the monitoring unit are connected.

The monitoring unit may be located on an outer side of the door; one end of the cable may be coupled to the monitoring unit and a portion of the cable adjacent to the end of the cable may be arranged on an inner side of the door; the other end of the cable may be coupled to the micom and another portion of the cable adjacent to the other end of the cable may be arranged on an inner side of the side of the case.

The one end of the cable may bore through the door and may be coupled to the monitoring unit.

The decoupling portion may be provided between a portion of the cable arranged on the door and a portion arranged on a side of the case.

The door may be separable from the case, and the case may be separable in the decoupling portion when the door is separated.

The oven may further include a storage room provided under the cooking room, and the decoupling portion may be provided in a region corresponding to the height of the storage room.

The decoupling portion may be exposed to the outside of the oven when the storage room is opened.

The oven in accordance with the present disclosure improves user convenience by allowing the user to check a cooking process through a monitoring unit without need to directly look into the transparent window or to open the door to check inside, and increases efficiency of the monitoring unit with a power supply cable detachably provided in the monitoring unit.

DETAILED DESCRIPTION

Figure 1:
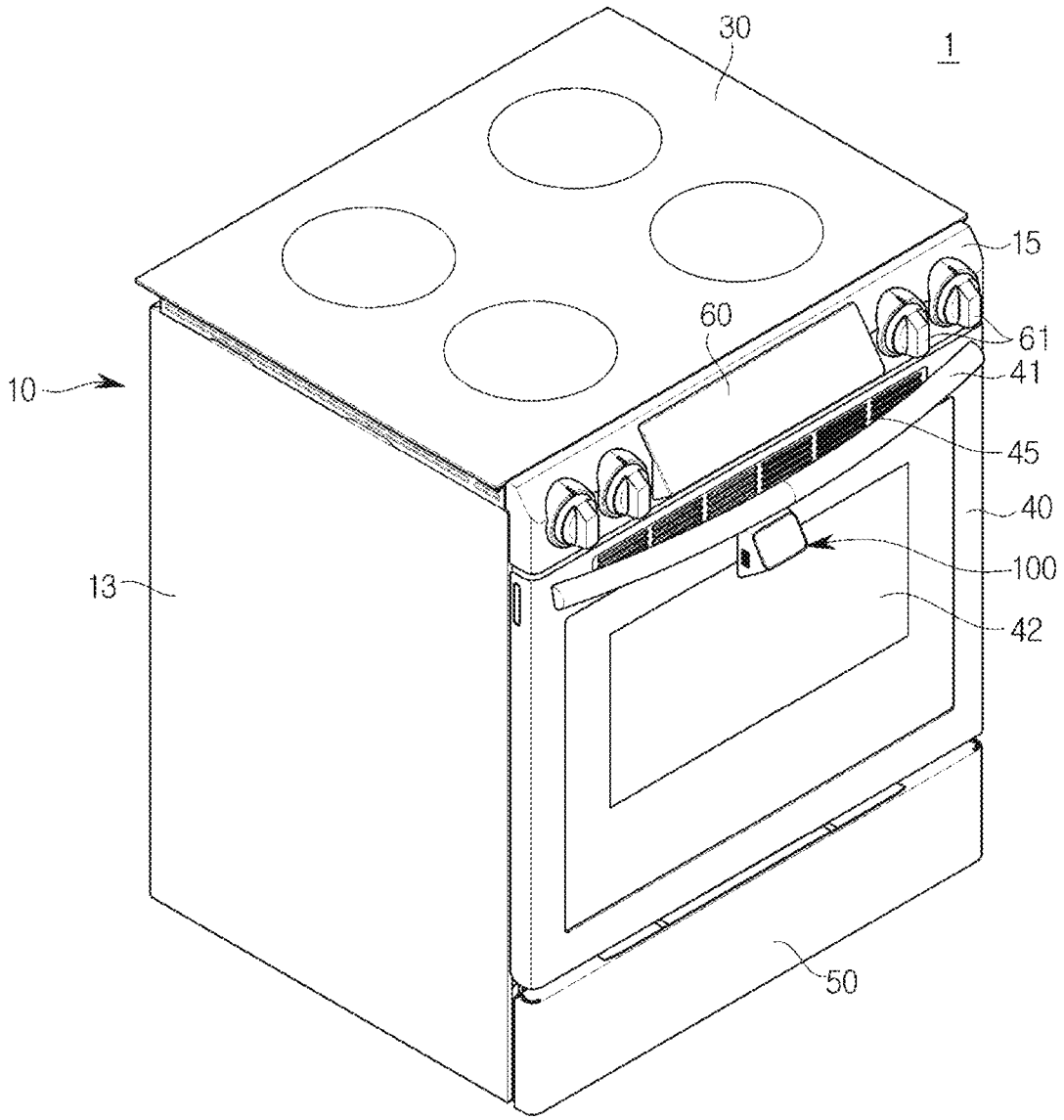
FIG. 1 is a perspective view of an oven, according to an embodiment of the present disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

Reference will now be made in detail to embodiments, examples of which are illustrated in the accompanying drawings, wherein like reference numerals refer to the like elements throughout.

The terms front and forward as herein used refer to a front face and front direction viewed with respect to an oven 1 as shown in FIG. 1, and a rear direction refers to a direction facing backward from the oven 1.

Figure 2:
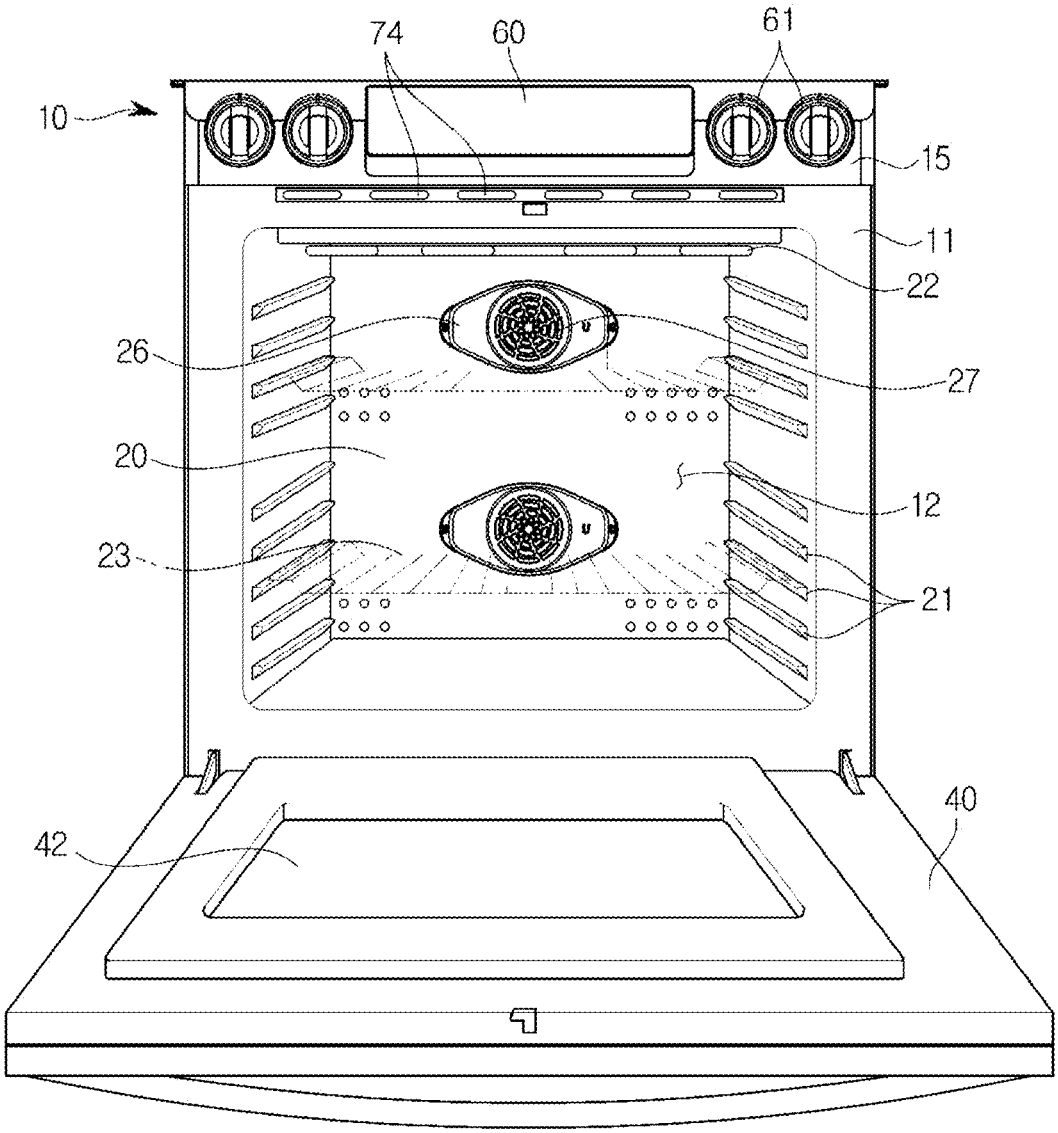
FIG. 2 is a view with a door open, according to an embodiment of the present disclosure.
Figure 3:
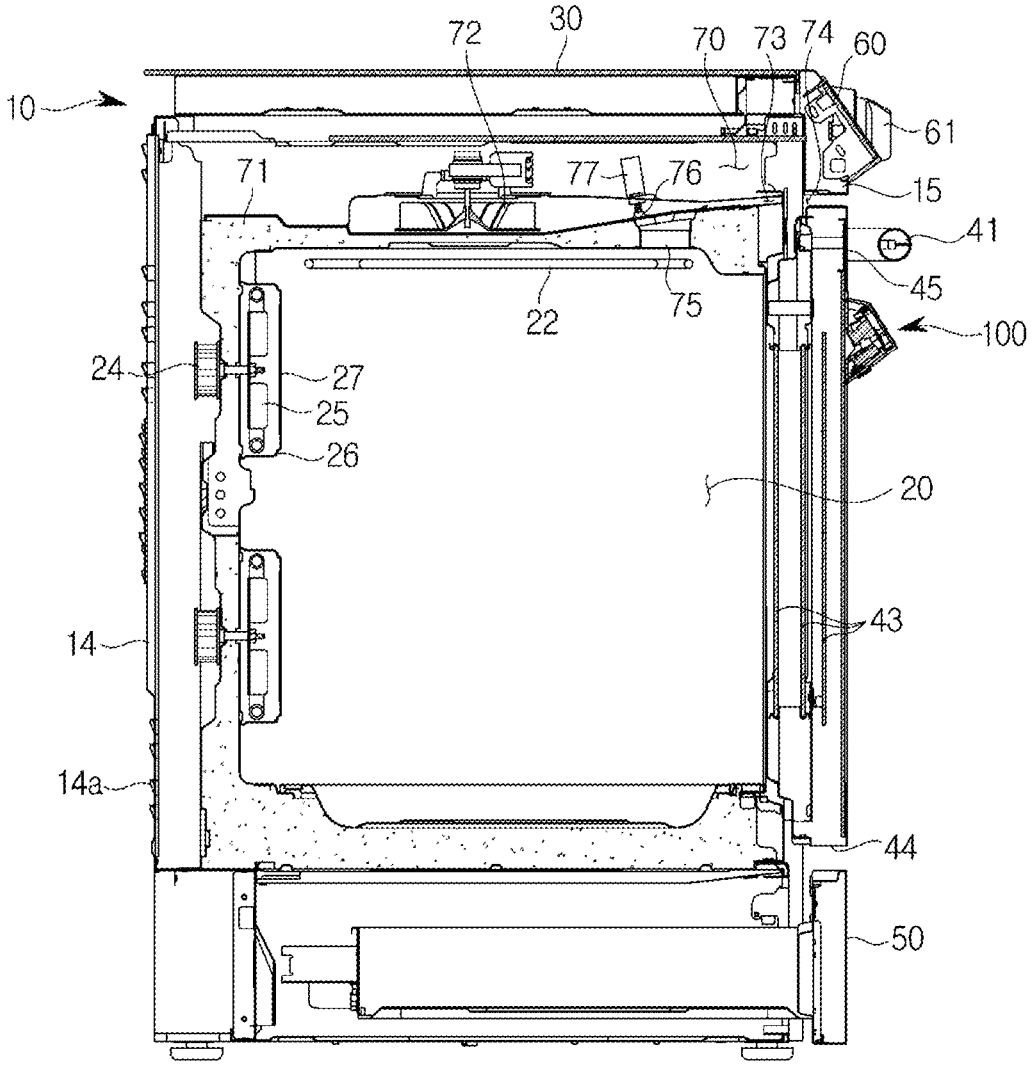
FIG. 3 is a side cross-sectional view of an oven, according to an embodiment of the present disclosure.

FIG. 1 is a perspective view of an oven, according to an embodiment of the present disclosure, FIG. 2 is a view with a door of an oven open, according to an embodiment of the present disclosure, and FIG. 3 is a side cross-sectional view of an oven, according to an embodiment of the present disclosure.

The oven 1 (or a main body including a case and a door, which is hereinafter collectively called an oven) may include a case 10 forming the exterior, a cooking room 20 located inside the case 10, and a cooktop 30 arranged on the top of the oven 1 for heating a container with a material to be cooked placed thereon.

The case 10 may include a front panel 11 forming the front of the case 10, side panels 13 forming the sides of the case 10, and a rear panel 14 forming the back of the case 10.

The cooking room 20 is provided in the form of a box inside the case 10 and may have the front open to draw out a material. The front panel 11 may have an opening 12 formed to correspond to the cooking room 20 with the open front.

The open front of the cooking room 20 may be opened or closed by the door 40. The door 40 may be hinged on a lower side of the case 10 to be able to pivot on the case 10, and may have a handle 41 to be gripped by the user.

The door 40 may include a visible portion 42 made of a transparent material, such as glass to allow checking a cooking process of the material inside the cooking room 20 from the outside.

A plurality of glass members 43 may be provided on the inner side of the door 40. They allow looking into the cooking room 20 through the visible portion 42, and may be made of other transparent members than the glass.

There may be a door suction port 44 provided on the lower portion of the door 40 to suck in air to the inside of the door 40. This is to cool the heat inside the door 40 through air circulation in order to prevent the hot air produced in the cooking room 20 from being transferred to the outer surface of the door 40.

The outside air flowing in from the lower portion of the door 40 may exchange heat with the hot air transferred from the cooking room 20 while moving up the door 40, and then may be discharged by a door discharging port 45 placed on the front of the door 40.

A storage room 50 may be provided under the cooking room 20 to keep e.g., containers for cooking. The storage room 50 may slide into or out of the oven 1 in the front direction or backward direction of the oven 1.

A plurality of supporters 21 may be provided inside the cooking room 20. Racks 23 may be mounted on the plurality of supporters 21 to put a material to be cooked thereon. The plurality of supporters 21 may protrude from the left side wall and the right side wall of the cooking room 20.

A divider (not shown) may be detachably mounted on the plurality of supporters 21 to divide the cooking room 20. Specifically, the divider may be horizontally mounted in the cooking room 20 to divide the cooking room 20 into multiple rooms.

The multiple cooking rooms 20 may not be necessarily equal but may be different in size. The divider has an insulation material to insulate each cooking room 20. This may allow the space of the cooking room 20 to be variously used according to the user's intention.

A heater 22 may be provided in the cooking room 20 to heat the material to be cooked. In the embodiment, the heater 22 may be an electric heater including an electric resistor. Alternatively, the heater 22 may be a gas heater for producing heat by burning a gas. That is, the oven 1 in accordance with embodiments of the present disclosure includes an electric oven and a gas oven.

A circulation fan 25 to evenly heat the material by circulating air in the cooking room 20 and a circulation motor 24 to drive the circulation fan 25 may be provided in the back of the cooking room 20. A fan cover 26 may be provided to cover the circulation fan 25 in front of the circulation fan 25, and there are through holes 27 on the fan cover 26 to allow airflow.

A display module 60 may be provided on an upper front portion of the front panel 11 to display various operation information of the oven 1 and to allow the user to enter operation commands. The display module 60 may be mounted on a machine room cover 15.

There may also be operation parts 61 arranged on the machine room cover 15 to additionally operate the oven 1.

The oven 1 has a machine room 70 containing electric parts to control operation of various components including the display module 60. The machine room 70 is provided above the cooking room 20. There may be an insulation member 71 arranged between the machine room 70 and the cooking room 20 to insulate the machine room 70 and the cooking room 20 to prevent the hot air in the cooking room 20 from being transferred to the machine room 70.

Furthermore, the insulation member 71 may be provided to cover not only the machine room 70 and the cooking room 20 but also the outside of the cooking room 20 on the whole to prevent the hot air in the cooking room 20 from being transferred to the outside of the oven 1.

The oven 1 has a cooling structure to cool off the machine room 70 by circulating the air around the cooking room 20. The cooling structure of the oven 1 may include a cooling fan unit 72 for moving air and a cooling path 73 for discharging the air sucked in by the cooling fan unit 72 forward from the oven 1.

Specifically, the air outside the main body may be sucked into the machine room 70 via through holes 14*a* formed on the rear panel 14, and the air sucked into the machine room 70 may be moved around inside the machine room 70 to cool off the electric components and may be finally discharged forward from the oven 1 through the discharging port 74 along the cooling path 73.

Some air in the cooking room 20 may be sucked into the cooling path 73 through a discharging path 75 and then be discharged forward from the oven 1. A bypass hole 76 may further be formed to move some air flowing to the discharging port 74 from the cooling path 73 to the discharging path 75. The bypass hole 76 may be opened or closed by an open/close device 77, and by opening/closing the bypass hole 76, a discharging amount of the air in the cooking room 20 to be discharged to the cooling path 73 may be adjusted.

A monitoring unit 100 for taking an image of the inside of the cooking room 20 will now be described in detail.

Figure 4:
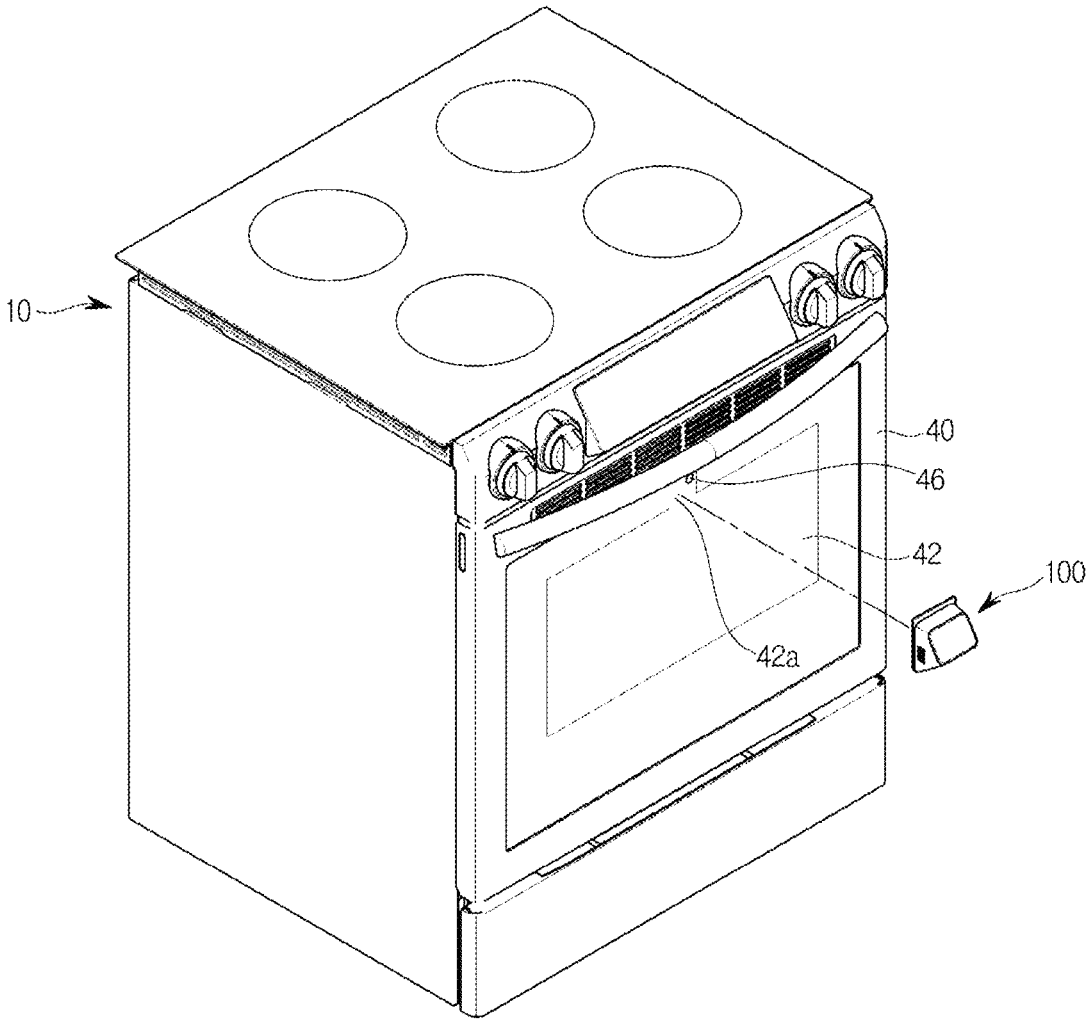
FIG. 4 is a view with a main body of an oven and a monitoring unit separated from each other, according to an embodiment of the present disclosure.
Figure 5:
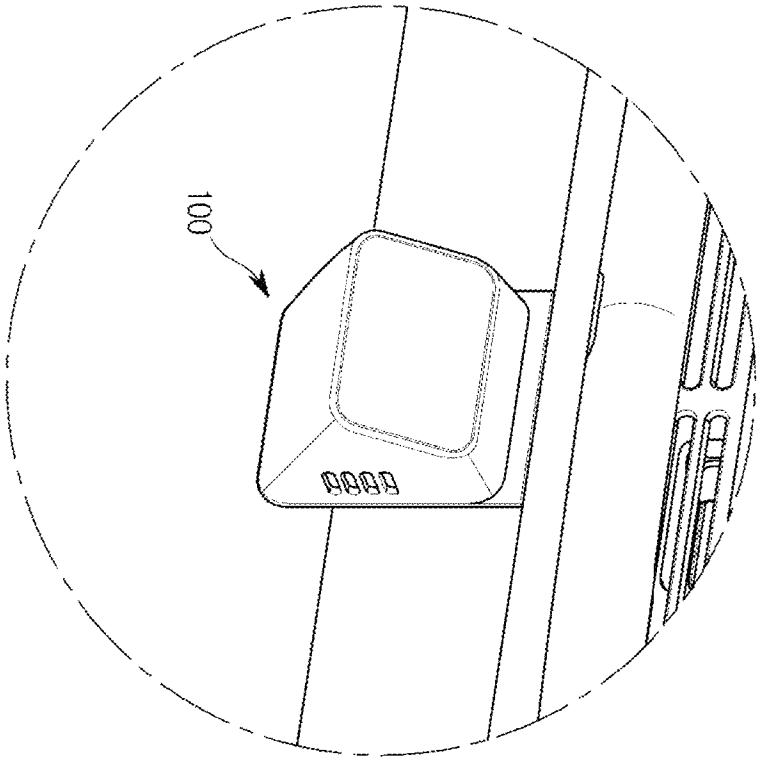
FIG. 5 is an enlarged perspective view of a monitoring unit, according to an embodiment of the present disclosure.
Figure 6:
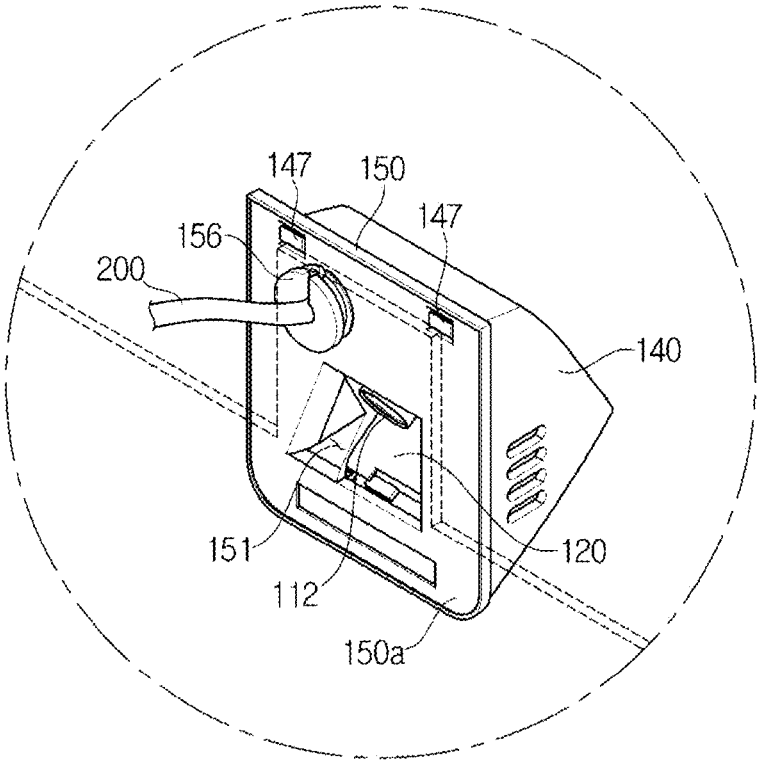
FIG. 6 is an enlarged rear perspective view of a monitoring unit, according to an embodiment of the present disclosure.
Figure 7:
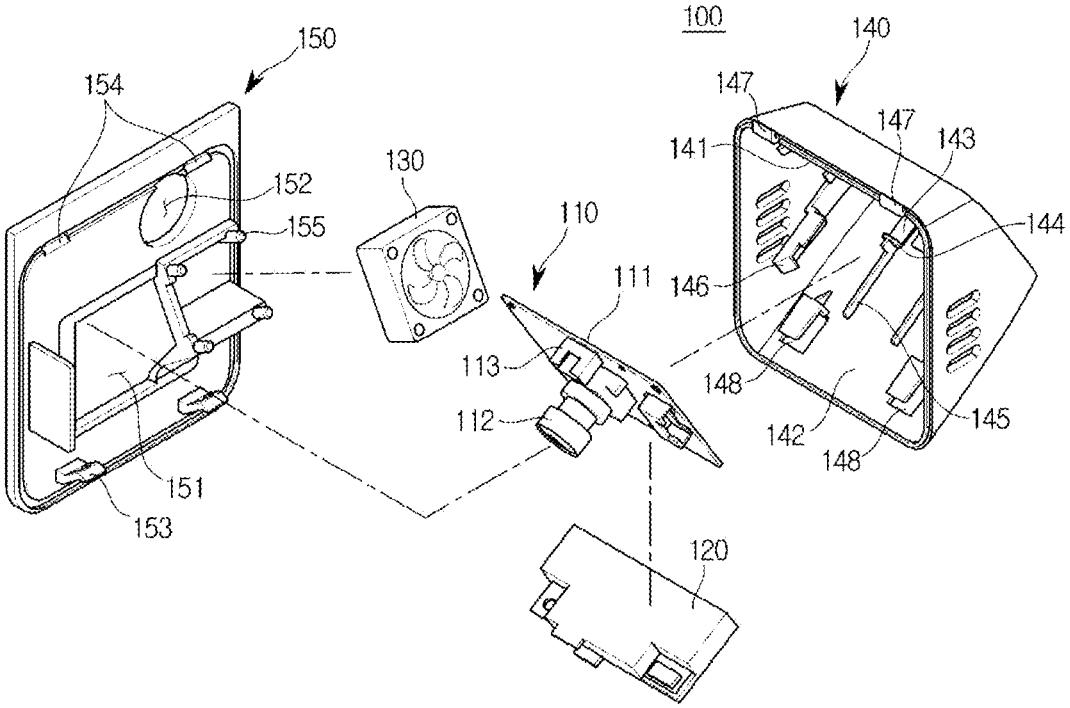
FIG. 7 is an exploded view of a monitoring unit, according to an embodiment of the present disclosure.
Figure 8:
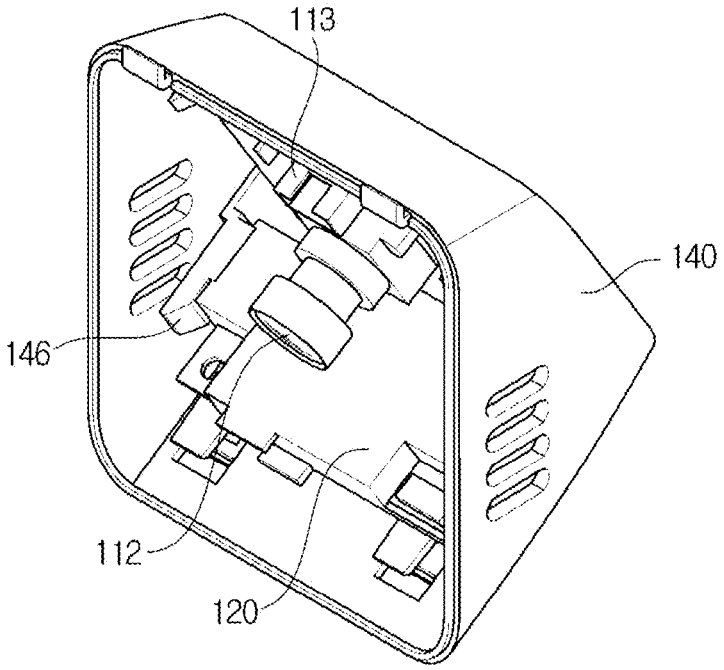
FIG. 8 is a bottom perspective view of a monitoring unit with a first housing removed, according to an embodiment of the present disclosure.
Figure 9:
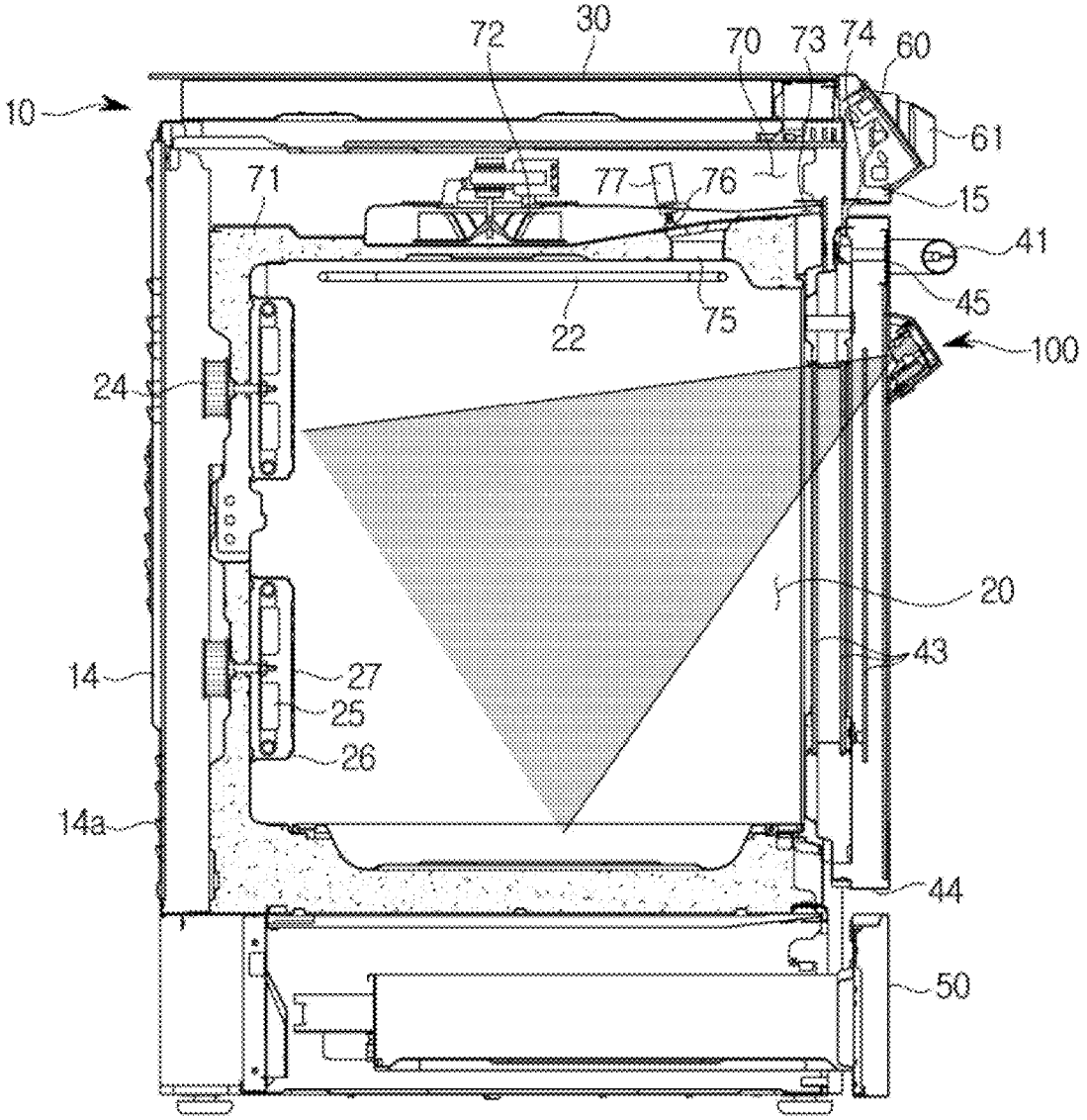
FIG. 9 schematically shows an imaging range of a monitoring unit, according to an embodiment of the present disclosure.

FIG. 4 is a view with a main body of an oven and a monitoring unit separated from each other, according to an embodiment of the present disclosure, FIG. 5 is an enlarged perspective view of a monitoring unit, according to an embodiment of the present disclosure, FIG. 6 is an enlarged rear perspective view of a monitoring unit, according to an embodiment of the present disclosure, FIG. 7 is an exploded view of a monitoring unit, according to an embodiment of the present disclosure, FIG. 8 is a bottom perspective view of a monitoring unit with a first housing removed, according to an embodiment of the present disclosure, and FIG. 9 schematically shows an imaging range of a monitoring unit, according to an embodiment of the present disclosure.

As shown in FIGS. 4 and 5, the monitoring unit 100 may be arranged on the outer side of the door 40. Specifically, it may be provided on the outer side of the visible portion 42 equipped in the door 40 for taking an image of the inside of the cooking room 20 by seeing through the visible portion 42 from the outside of the door 40.

As described above, the visible portion 42 may be made of a transparent material, and when the plurality of glass members 43 are arranged at positions on the inner side of the door 40 corresponding to the visible portion 42 and the monitoring unit 100 is positioned on the outer side of the visible portion 42, the monitoring unit 100 may take an image of the inside of the cooking room 20 even without being located inside the cooking room 20 or inside the door 40.

if the monitoring unit 100 is located inside the cooking room 20, the monitoring unit 100 is required to have high heat resistance because the cooking room 20 remains at the temperature of about 200 degrees during cooking and rises up to the temperature of 450 degrees during self-cleaning.

To avoid the situation, the monitoring unit 100 is arranged on the outside of the door 40. It is economically efficient because no additional heatproof configuration or particular heatproof technique is required because the heat transferred to the outside of the door 40 has the temperature of about 65 degrees maximum, which requires no significant heat resistance.

Unlike an embodiment of the present disclosure, the monitoring unit 100 may be arranged on a side of the case 10 instead of the door 40, and the additional visible portion 42 may be provided to see into the cooking room 20 at where the monitoring unit 100 is located.

A corresponding portion 42*a* to correspond to the position where the monitoring unit 100 is placed may be provided on one side of the visible portion 42. It is not necessary for the corresponding portion 42*a* to be provided at a particular position except that it is provided to correspond to the position where the monitoring unit 100 is placed.

The monitoring unit 100 may be placed at a position to take an image of the entire interior of the cooking room 20 taking into account a maximum imaging angle (maximum camera imaging angle) of the camera module 110 of the monitoring unit 100.

Depending on the maximum imaging angle of the camera module 110 and the size of the cooking room 20, it may be provided on a side of the outer side of the visible portion 42 with no extra corresponding portion 42*a* provided.

The monitoring unit 100 may be configured to have the camera module 110 for capturing the interior of the cooking room 20, a communication board 120 for transmitting the captured information from the camera module 110 to an external device and receiving information from an external device, a cooling fan 130 for cooling off the camera module 110, and a housing 140, 150 forming the exterior of the monitoring unit 100.

The camera module 110 may include a camera 112 capable of taking images and video, a connector 113 connected to a cable, which will be described later, to receive power and transmit or receive electric information, and a camera board 111 on which other electronic parts in addition to the camera 112 and the connector 113 are settled.

The camera 112 may observe the inside of the cooking room 20 through the visible portion 42. The camera 112 may have an imaging angle of about 60 degrees upward and downward, and an imaging angle of about 100 degrees to the left and right.

Based on the maximum imaging angle of the camera 112, an angle at which the camera module 110 is placed may be determined. The camera module 110 may be placed at such an angle with the inner side of the door 40 that all the interior of the cooking room 20 falls under the maximum imaging angle.

Preferably, it may be slantingly placed on an upper portion of the visible portion 42 at a certain angle with the visible portion 42 (see FIG. 9).

The communication board 120 may send image information or video information regarding the inside of the cooking room 20 formed by the camera module 110 to an external device. The communication board 120 may transmit information formed by an external device and receive information from an external device in various communication schemes.

For example, it may transmit/receive information within a predetermined range in a communication scheme, such as third generation (3G), fourth generation (4G), etc., and furthermore, it may transmit/receive information within a range in a communication scheme, such as Wireless LAN, Wi-Fi, Bluetooth, Zigbee, Wi-Fi Direct (WFD), Ultra Wideband (UWB), Infrared Data Association (IrDA), Bluetooth Low Energy (BLE), Near Field Communication (NFC), etc.

In some cases, the communication board 120 may be provided inside the case 10 instead of the inside of the monitoring unit 100. The case 10 of the oven 1 may be typically made of a member including steel to secure heat resistance, and the communication board 120 may be restricted from communication when arranged inside the member including the steel, so it is preferable for the communication board 120 to be placed in the monitoring unit 100 provided outside the case 10.

Transmitting and receiving information by the communication board 120 will be described later in detail.

The cooling fan 130 may be provided on one side of the camera module 110 to cool off the camera module 110. The monitoring unit 100 may be provided to be adjacent to the door 40 to which some of the heat of the cooking room 20 is transferred, and may thus have the temperature higher than normal temperature.

The cooling fan 130 may cool the heat produced by the camera module 110 itself and the temperature (about 65 degrees) higher than normal temperature produced from the outside of the monitoring unit 100 for the camera module 110 to be stably driven.

The housing forming the exterior of the monitoring unit 100 may be comprised of a first housing 140 in which the camera module 110 and the communication board 120 are settled and the second housing 150 adjoining the outer side of the door 40.

The first housing 140 may include the space having an opening on one side for the camera module 110 and the communication board 120 to be stably seated therein. Specifically, a first seat 141 in which the camera module 110 is stably seated and a second seat 142 in which the communication board 120 is stably seated may be included inside the first housing 140.

Since the camera module 110 is placed on the door 40 with a certain inclination, as described above, the first seat 141 may be arranged to have an inclination corresponding to the inclination of the camera module 110.

A side of the first seat 141 adjacent to the second seat 142 may include a first supporting projection 143 protruding from the first seat 141 to the second seat 142 and adjoining the lower side of the camera module 110 for the camera module 110 to be supported in parallel with the first seat 141, and a first fixing hook 144 for fixing the camera module 110 safely seated on the first supporting projection 143.

Although not shown in FIG. 7, a configuration similar to the first supporting projection 143 and the first fixing hook 144 may be provided on the upper side of the first seat 141 to support the upper side of the camera module 110.

The second seat 142 may include a second supporting projection 145 protruding upward from the second seat 142 to support the lower side of the communication board 120. Furthermore, second fixing hooks 146 protruding inward from a pair of side portions of the first housing 140 are provided to fix the communication board 120 supported against the second supporting projection.

The first and second supporting projections 143, 145 and the first and second fixing hooks 144, 146 are not limited to the embodiment of the present disclosure, but may have various forms for the camera module 110 and the communication board 120 to be settled in the first housing 140.

The communication board 120 may be arranged as close to the second seat 142 as possible. Specifically, there is no other configuration provided between the communication board 120 and the first housing where the second seat 142 is arranged.

This is not to interfere with communication when the communication board 120 transmits/receives information to/from an external device. For this reason, even if a portion of the monitoring unit 100 is arranged inside the door 40 or inside the case 10 unlike the embodiment of the present disclosure, the communication board may be arranged on the outside of the door 40 or on the outside of the case 10.

A first coupling hook 147 may be provided in the upper portion of the opening of the first housing 140 to be coupled to the second housing 150. The first coupling hook 147 may be provided to correspond to a first coupling recess 154 provided in the second housing 150, so that it may be inserted and coupled to the first coupling recess 154 when the first housing 140 and the second housing 150 contact each other correspondingly.

Furthermore, a second coupling hook 148 may be provided in the lower portion of the opening of the first housing 140 to be coupled to the second housing 150. The second coupling recess 148 is formed to correspond to the second coupling hook 153 provided in the second housing 150.

The first and second coupling hooks 147, 153 and the first and second coupling recesses 154, 148 are not limited to the embodiment of the present disclosure, but may be formed upside down.

The second housing 150 may be provided to be separable from the first housing 140 as described above, and may be provided to be coupled to the door 40.

The second housing 150 has the form of a plate, including an install plane 150*a* on the opposite side to the door 40. The install plane 150*a* may be provided parallel to the door 40 and attached to the outer surface of the door 40 by an adhesive, and may be coupled to the outer surface of the door 40 by an extra install member (e.g., by screwing or by hooking).

The second housing 150 may include an open portion 151, which is opened for the camera module 110 settled in the first housing 140 to see through the second housing 150 to capture an image of the inside of the cooking room 20.

The open portion 151 may have a size determined by taking into account an installation angle of the camera module 110 and the imaging angle of the camera 112.

A cable through hole 152 for the cable 200 electrically connecting the camera module 110 and a micom 300, which will be described later, to be connected to the inside of the monitoring unit 100 may be provided on one side of the second housing 150.

The cable through hole 152 may be formed at a position corresponding to the door through hole 46 formed for the cable 200 to bore through the door 40 from inside to outside (see FIG. 4). The cable 200 connected from the micom 300 may go inside the door 40, pass through the door through hole 46 and the cable through hole 152, and may be connected to the inside of the monitoring unit 100.

A sealing member 156 may be provided on the inner side of the cable through hole 152. This is to prevent heat produced from the door 40 from being transferred to the inside of the monitoring unit 100 by blocking separation between the cable through hole 152 and the cable 200.

A cooling fan supporting projection 155 may be provided on a side of the second housing 150 facing the first housing 140 for the cooling fan 130 to be placed.

To increase cooling efficiency of the cooling fan 130 by being provided adjacent and parallel to the camera module 110, the cooling fan supporting projection 155 may protrude toward the first housing 140 with a certain inclination to the second housing 150 for the cooling fan 130 to be arranged at the same inclination as the camera module 110.

As for order of installation of the monitoring unit 100, the monitoring unit 100 is first placed at a position (corresponding portion 42*a*) corresponding to the door through hole 46 and the cable through hole 152, and attached such that the install plane 150*a* adjoins the door 40.

Subsequently, the first housing 140 in which the camera module 110 and the communication board 120 are settled is placed to correspond to the second housing 150, and hooked thereto by pressing the first housing 140 to the opposite side.

Once the housings 140, 150 are coupled, the housings 140, 150 may be separated by pressing the housings 140, 150 to the opposite sides in order to replace components provided inside the housings 140, 150. In other words, the second housing 150 may be detached from the first housing 140 by pressing it to the opposite side.

Furthermore, a certain size of an opening (not shown) may be formed on one side of the first housing 140 to replace the internal components through the opening without decoupling the first housing 140 and the second housing 150. In this case, the opening may be formed to be shut by an extra packing member (not shown) and may be opened only to replace an internal component.

As described above, to prevent limitation on communication of the communication board 120, the housings 140, 150 may be made of a material including e.g., a plastic resin.

Figure 10:
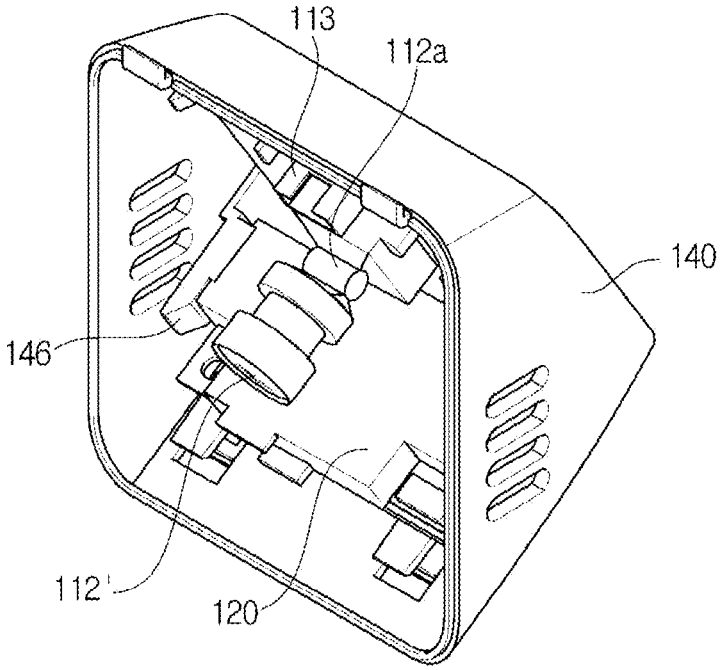
FIG. 10 is a bottom perspective view of a monitoring unit with a first housing removed, according to another embodiment of the present disclosure.

FIG. 10 is a bottom perspective view of a monitoring unit with a first housing removed, according to another embodiment of the present disclosure. In the following description, configurations other than those as will be described particularly, are the same as the configurations of the oven 1.

A camera 112' may be provided to be rotatable by a rotation member 112*a*.

The rotation member 112*a* may be provided between the camera 112' and the camera board 111 to be rotated to rotate the camera 112'. The rotation member 112*a* may have a hinge structure for the camera 112' to be tilted up or down, to the left or right, or may have a ball structure for the camera 112' to be freely rotated.

As the camera 112' is rotatable, a range within which the camera 112' may take images may become wide, and the camera 112' may be rotated to the height of a rack 23 on which a material to be cooked is placed, to obtain information about a clear image to meet the needs of the user.

The cable 200 electrically connecting the micom 300 and the monitoring unit 100 will now be described in detail.

Figure 11:
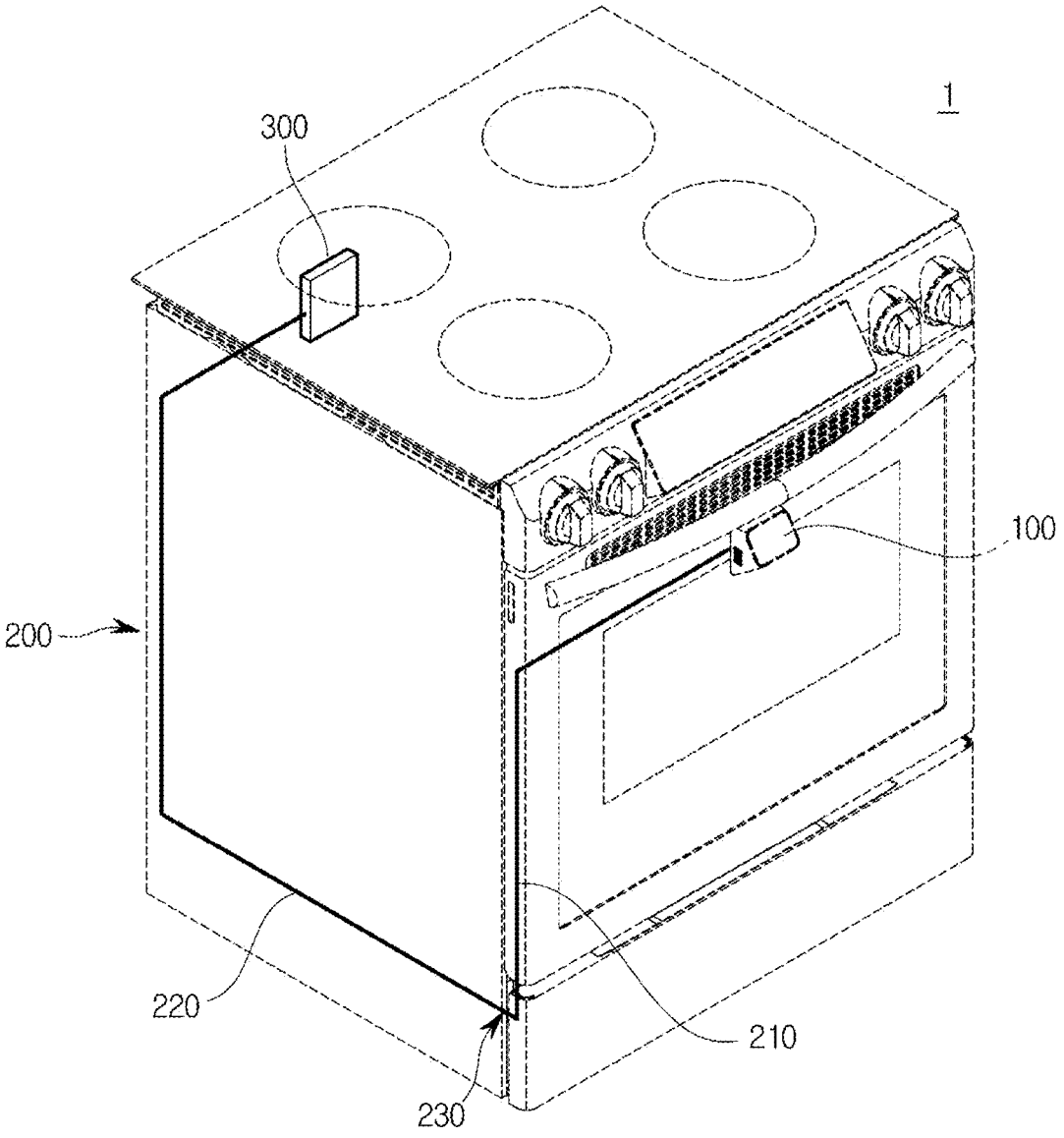
FIG. 11 shows overall arrangement of a cable, according to an embodiment of the present disclosure.
Figure 12:
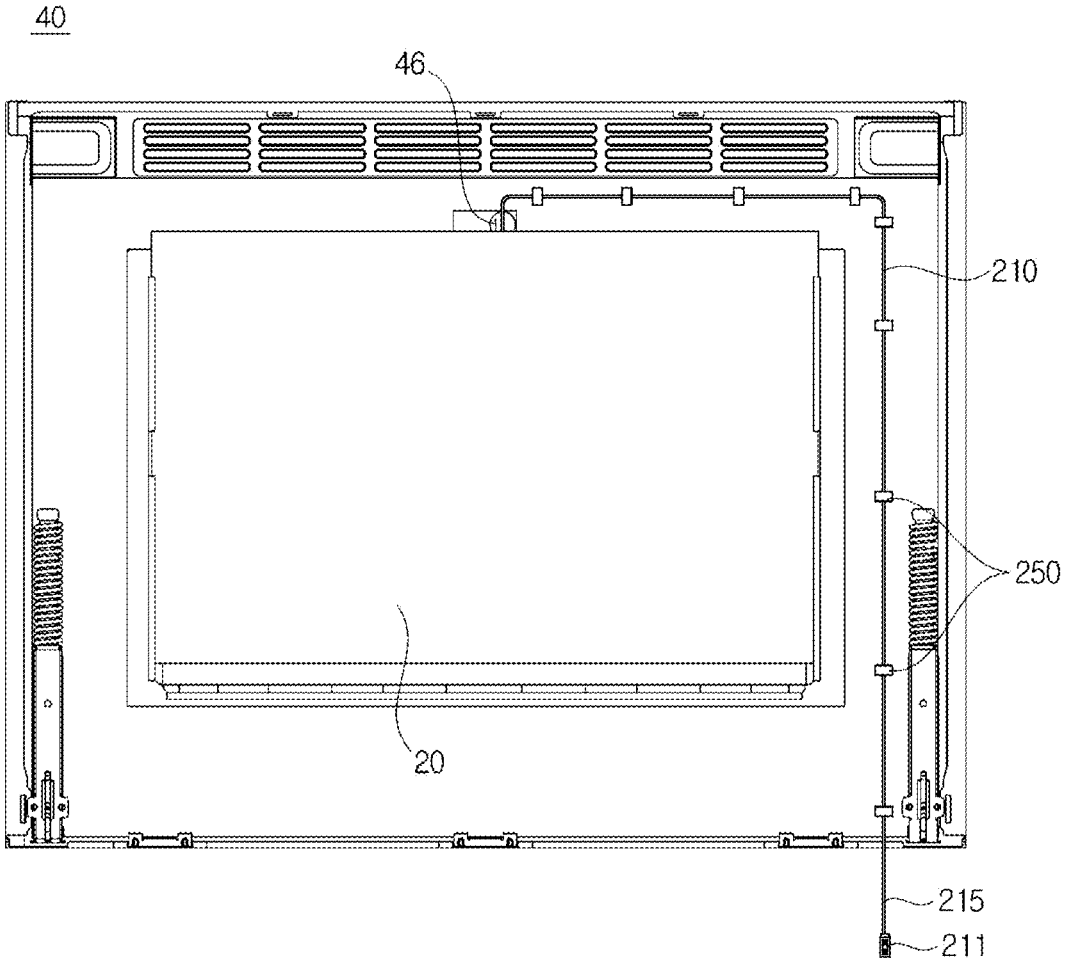
FIG. 12 shows a cable arranged on a side of a case with a side panel removed, according to an embodiment of the present disclosure.
Figure 13:
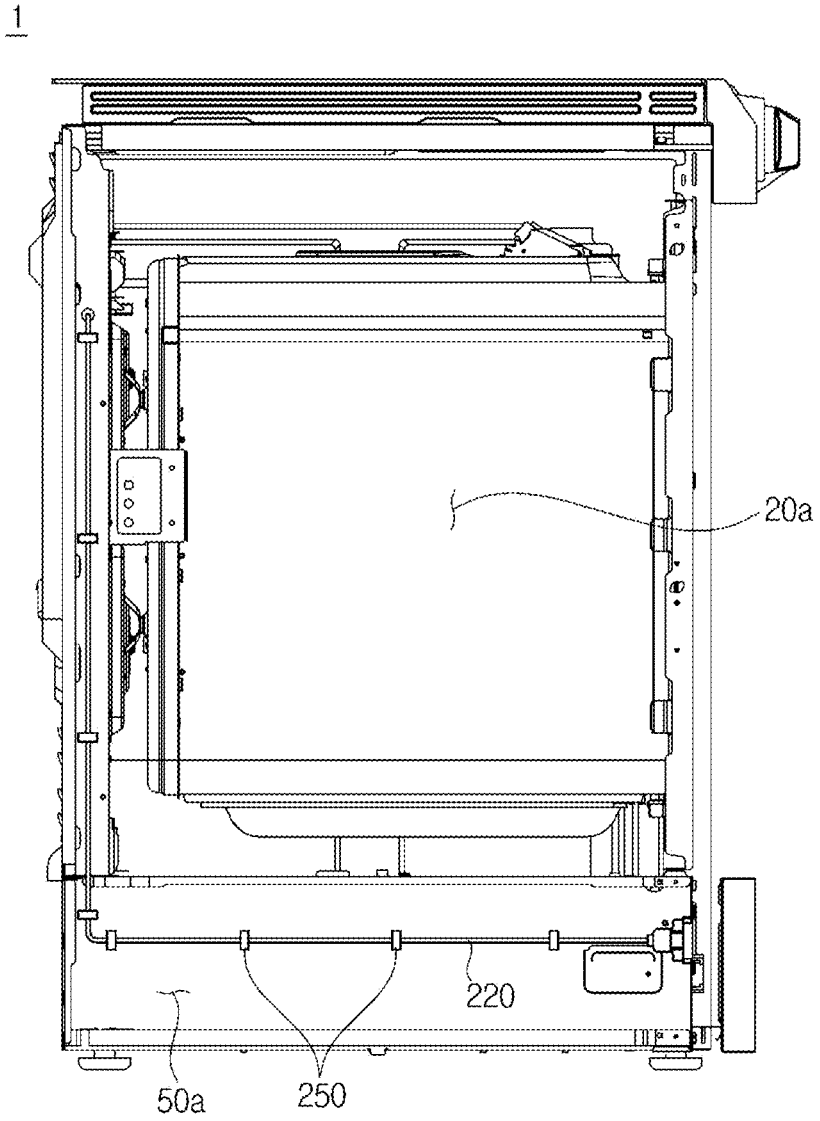
FIG. 13 shows a cable arranged on the inner side of a door, according to an embodiment of the present disclosure.
Figure 14:
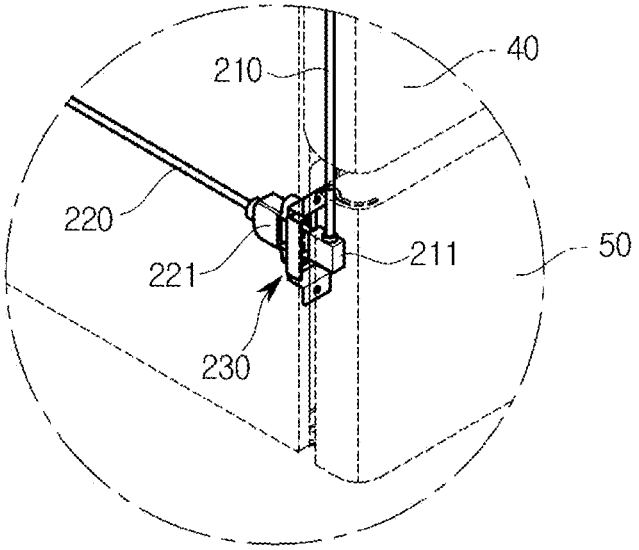
FIG. 14 is an enlarged view of a decoupling section of a cable, according to an embodiment of the present disclosure.
Figure 15:
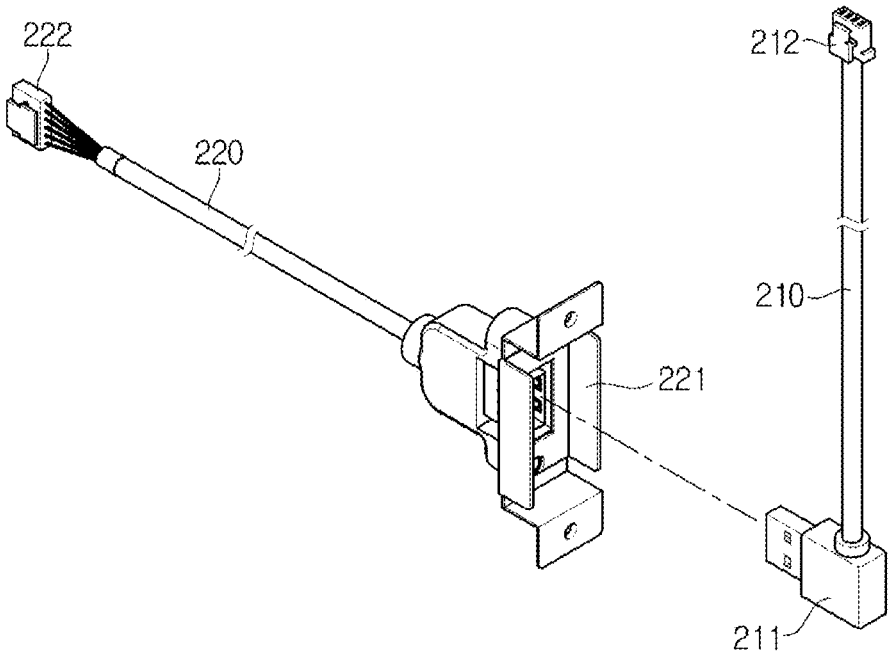
FIG. 15 is a perspective view of a cable, according to an embodiment of the present disclosure.
Figure 16:
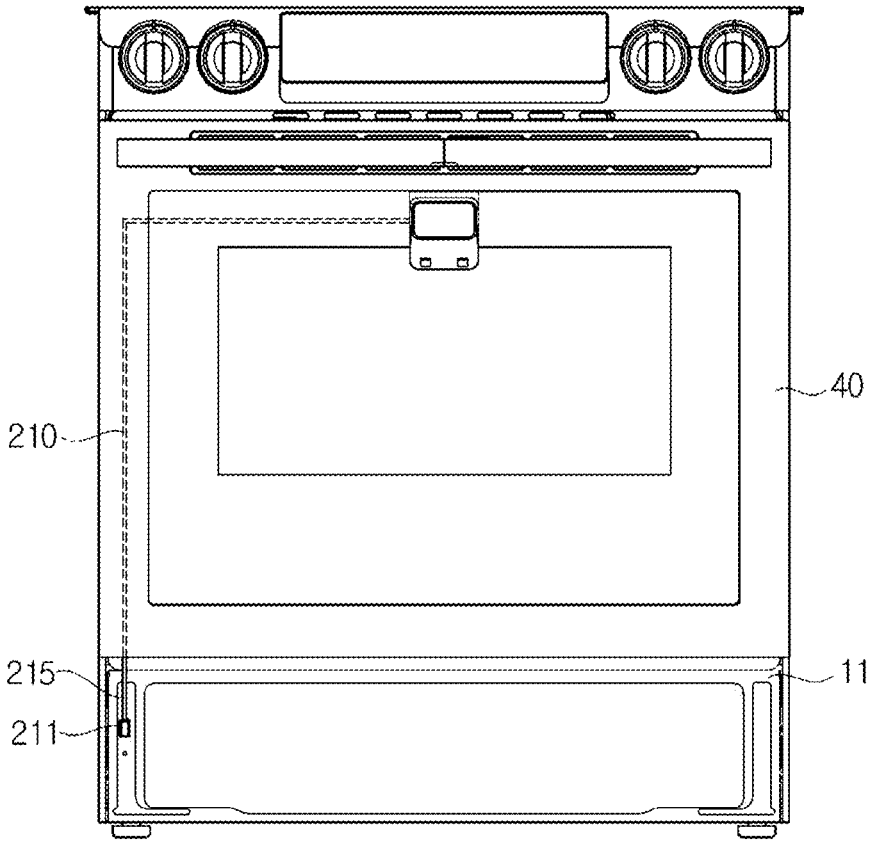
FIG. 16 is a front view with a storage room removed, according to an embodiment of the present disclosure.
Figure 17:
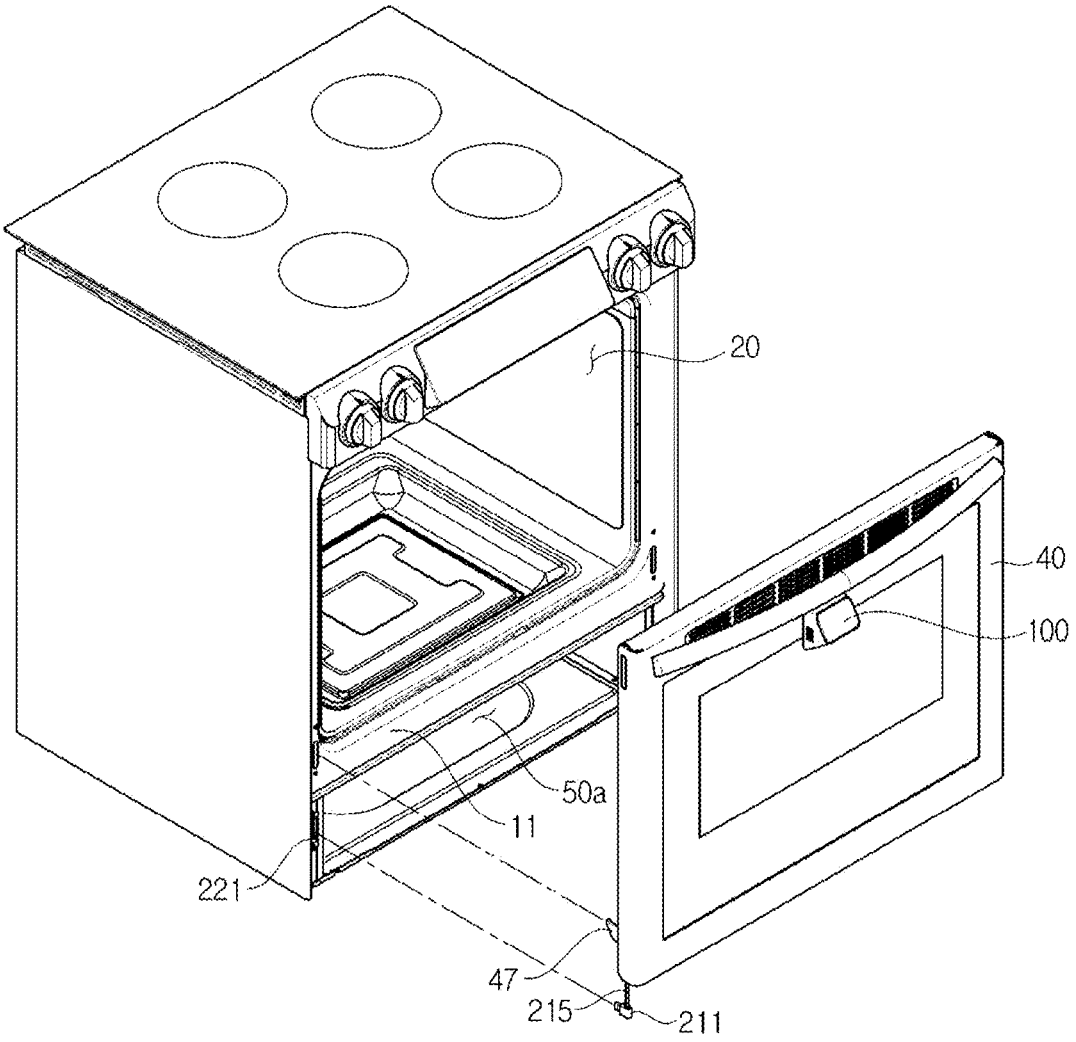
FIG. 17 shows a door separated from a case while a storage room is removed, according to an embodiment of the present disclosure.

FIG. 11 shows overall arrangement of a cable, according to an embodiment of the present disclosure, FIG. 12 shows a cable arranged on a side of a case with a side panel removed, according to an embodiment of the present disclosure, FIG. 13 shows a cable arranged on the inner side of a door, according to an embodiment of the present disclosure, FIG. 14 is an enlarged view of a decoupling section of a cable, according to an embodiment of the present disclosure, FIG. 15 is a perspective view of a cable, according to an embodiment of the present disclosure, FIG. 16 is a front view with a storage room removed, according to an embodiment of the present disclosure, and FIG. 17 shows a door separated from a case while a storage room is removed, according to an embodiment of the present disclosure.

The oven 1 may include the micom 300 for controlling the monitoring unit 100.

The micom 300 may be configured to control only the monitoring unit 100 separately, or may be configured to control the overall operation of the oven 1 and additionally control the monitoring unit 100. In the following description, the micom 300 is assumed to be configured to control the monitoring unit 100 and the oven 1.

Furthermore, the micom 300 is defined as including a microcomputer formed in a chip, a substrate with the microcomputer mounted thereon, and various electric parts, such as a power supplier, etc., for driving various microcomputers.

The cable 200 may be connected between the micom 300 and the monitoring unit 100. The cable 200 may allow the micom 300 and the monitoring unit 100 to be electrically connected to each other.

The cable 200 may serve to supply power to the monitoring unit 100 and transmit/receive information between the micom 300 and the monitoring unit 100.

The micom 300 may be located on the inner side of the rear panel 14 of the oven 1. Accordingly, the cable 200 passes the inner side of the side panel 13 from the inner side of the rear panel 14.

Specifically, as shown in FIG. 12, the cable 200 connected from the micom 300 bends from inside of the rear panel 14 toward the inside of the side panel 13 and bends again toward the front of the oven 1 at the height corresponding to the storage room 50 to be arranged toward the front panel 11.

Inside the side panel 13, it is arranged to pass between the space in which the insulation member 71 is provided and the space in which the side panel 13 is provided, i.e., to go through a gap 20*a* between the outermost portion of the cooking room 20 and the side panel 13 and a gap 50*a* between the storage room 50 and the side panel 13 including the insulation member 71. This is to make it easy to replace the cable 200 in case that the cable 200 breaks.

In a section in which the cable 200 extends from the micom 300 to the front panel 11, the cable 200 may be fixed by a plurality of fixing members 250 fixed and supported on an arbitrary configuration of the oven 1 located inside the case 10.

The fixing member 250 may include a supporting hole formed for the cable 200 to be supported by passing through it. The supporting hole may be formed to have a diameter larger than the diameter of the cable 200 so that the cable 200 may be moved within a gap between the cable 200 and the supporting hole.

The fixing member 250 may be attached to any configuration of the oven 1 to support the cable 200.

The cable arranged on the inner side of the side panel 13 does not extend to the inner side of the front panel 11 but bores through the front panel 11, extending to the inner side of the door 40 to be connected to the monitoring unit 100. This is to make it easy to separate the cable 200 in case of decoupling the door 40 from the oven 1.

As for the cable 200, a portion of the cable 200 connected to the monitoring unit 100 and arranged on the inner side of the door 40 is called a first cable 210, and a portion of the cable 200 extending from the first cable 210 to be connected to the micom 300 and arranged on the inner side of the case 10 is called a second cable 220, and a decoupling portion 230 may be provided between the first cable 210 and the second cable 220 to separate the cable 200.

The first cable 210 may be connected to the monitoring unit 100 at one end. Specifically, it may be placed on the inner side of the door 40, passing through the door through hole 46 located on the outside of the door 40 and extending to the inside of the monitoring unit 100.

The first cable 210 may pass through the cable through hole 152 of the monitoring unit 100 to be connected to the connector 113 of the camera module 110.

As shown in FIG. 13, the first cable 210 may be arranged inside the door 40 not to correspond to the visible portion 42 for aesthetic reasons. Accordingly, the first cable extending from the door through hole 46 may run horizontally, bend at a portion of the side of the door 40, and extend downward.

The first cable 210 may be fixed to and arranged on the inside of the door 40 by the fixing member 250.

The other end of the first cable 210 extending down the door 40 may include an exposure portion 215 boring through the bottom of the door 40 and exposed to the outside. One end of the exposure portion 215, i.e., the other end of the first cable 210, may be connected to the second cable 220 located in the front panel 11.

One end of the second cable 220 may be connected to the micom 300 placed on the rear panel 14. The second cable 220 extends from the micom 300 to the inner side of the rear panel 14 and the side panel 13, as described above.

The other end of the second cable 220 may be arranged in the front panel 11 and connected to the first cable 210. Specifically, the other end of the second cable 220 may bore through the front panel 11 from behind and may be placed on the front of the front panel 11, thereby ending up being located on the front panel 11.

The decoupling portion 230 may be provided between the first cable 210 and the second cable 220. Specifically, it may be arranged on the front panel 11 in which the first cable 210 and the second cable 220 are connected, and may be located underneath the door 40.

The first cable 210 and the second cable 220 may be separated at the decoupling portion 230. Specifically, the other end of the first cable 210 may have a first coupler 211 to be coupled to the second cable, and one end of the second cable 220 may have a second coupler 221 to be coupled to the first coupler 211 of the first cable 210.

The first coupler 211 may be provided in the form of a USB connector, and the second coupler 221 may be provided in the form of a USB port, so that the first coupler 211 may be coupled to the second coupler 221 by being inserted thereto.

The second coupler 221 may be coupled to the front panel 11 by screwing, and accordingly, coupling/decoupling of the cable 200 may be enabled in such a form that the first coupler 211 is inserted to the front panel 11.

The decoupling portion 230 is provided to correspond to an end of the exposure portion 215, and is thus located underneath the door 40, which may be on a side at the height of the storage room 50.

Accordingly, when the storage room 50 is closed, the decoupling portion 230 is not exposed to the outside of the oven 1 because of the front portion of the storage room 50, and is exposed when the storage room 50 slides open.

In the latter case, it is easy for the user to press between the first cable 210 and the second cable 220 to separate the cable 200.

The user may separate the door from the case 10 as needed when cleaning the door 40, in which case the cable 200 may be separated from the case 10 along with the door 40 by separating the first cable 210 and the second cable 220 in the decoupling portion 230.

Since the monitoring unit 100 is arranged on the door, the monitoring unit 100 may be separated from the case 10 as well when the door 40 is separated. In this regard, the monitoring unit 100 is connected to the micom 300 via the cable 200, so if the cable 200 is not separated, some of the cable 200 extending into the case 10 may prevent the door 40 from being completely separated from the case 10 even if the door 40 is tried to be separated.

The decoupling portion 230 thus plays a role in allowing the user to completely separate the door 40 from the case 10.

A first connector 212 to be connected to the connector 113 of the monitoring unit 100 is provided at one end of the first cable 210, enabling the first cable 210 and the monitoring unit 100 to be electrically connected to each other.

A second connector 222 to be connected to the micom 300 is provided at the other end of the second cable 220, enabling the second cable 220 and the micom 300 to be electrically connected to each other.

Specifically, as described above, the micom 300 and the monitoring unit 100 may be electrically connected by the coupling between the first coupler 211 provided at the other end of the first cable 210 and the second coupler 221 of the second cable 220.

A decoupling procedure of the cable 200 as the door 40 is separated from the case 10 will now be described.

Before the door 40 is separated, the storage room 50 should be slid open to expose the decoupling portion 230 of the cable 200. While the storage room 50 is closed, the user has difficulty in accessing the decoupling portion 230 and is unable to separate the cable 200, and accordingly, the cable 200 remains connected to the inside of the case 10 and the door 40 may not be completely separated from the case 10.

As shown in FIGS. 15 and 16, when the storage room 50 is opened, the exposure portion 215 of the cable 200 and the decoupling portion 230 located on the exposure portion 215 may be exposed under the door 40.

The user may separate the first coupler 211 from the second coupler 221 by pulling the first coupler 211 placed in the exposure portion 215 or in the decoupling portion 230 forward from the oven 1. The cable 200 may be separated after the door 40 is first separated.

Unlike the embodiment of the present disclosure, in the case that the monitoring unit 100 is provided on an inner side of the case 10 instead of the side of the door 40, the monitoring unit 100 is not separated along with the separation of the door 40, so the decoupling portion 230 may not be provided and for separation of the door 40, the door 40 itself may be separated without need to additionally separate the cable 200.

The door 40 may be provided to pivot on a hinge 47 against the case 10. If the user presses the handle 41 of the door 40 downward with the hinge 47 used as a pivotal shaft, the door 40 may be pivoted downward to open the cooking room 20.

If the user presses the door 40 forward, the door 40 is separated from the case 10 as the hinge 47 is separated from the case 10. Accordingly, after the cable 200 is separated, the door 40 is pressed forward to be completely separated from the case 10.

After cleaning of the door 40, the door may be assembled to the case 10 in the same method. Specifically, the hinge 47 may be settled to the front panel 11 by pressing the door 40 toward the front panel 11, and then the first coupler 211 may be pressed toward the second coupler 221 to link the cable 200, and finally, the storage room 50 may be slid into a storage room in/out space.

As described above, as the cable 200 connected between the door 40 and the case 10 is provided to be separated, the manufacturing process of the oven 1 may become simpler.

Specifically, during the manufacturing process of the oven 1, after the door 40 and the case 10 are each pre-assembled by an assembly process, a process of assembling the door 40 and the case 10 may be introduced, thereby making it easy to produce the oven 1 and thus efficiently increasing the productivity.

A coupling structure of the cable 200 in accordance with another embodiment of the present disclosure will now be described. Other configurations of an oven 1*a* than the configurations which will be described below are the same as those in the previous embodiment, so the description thereof will be omitted.

Figure 18:
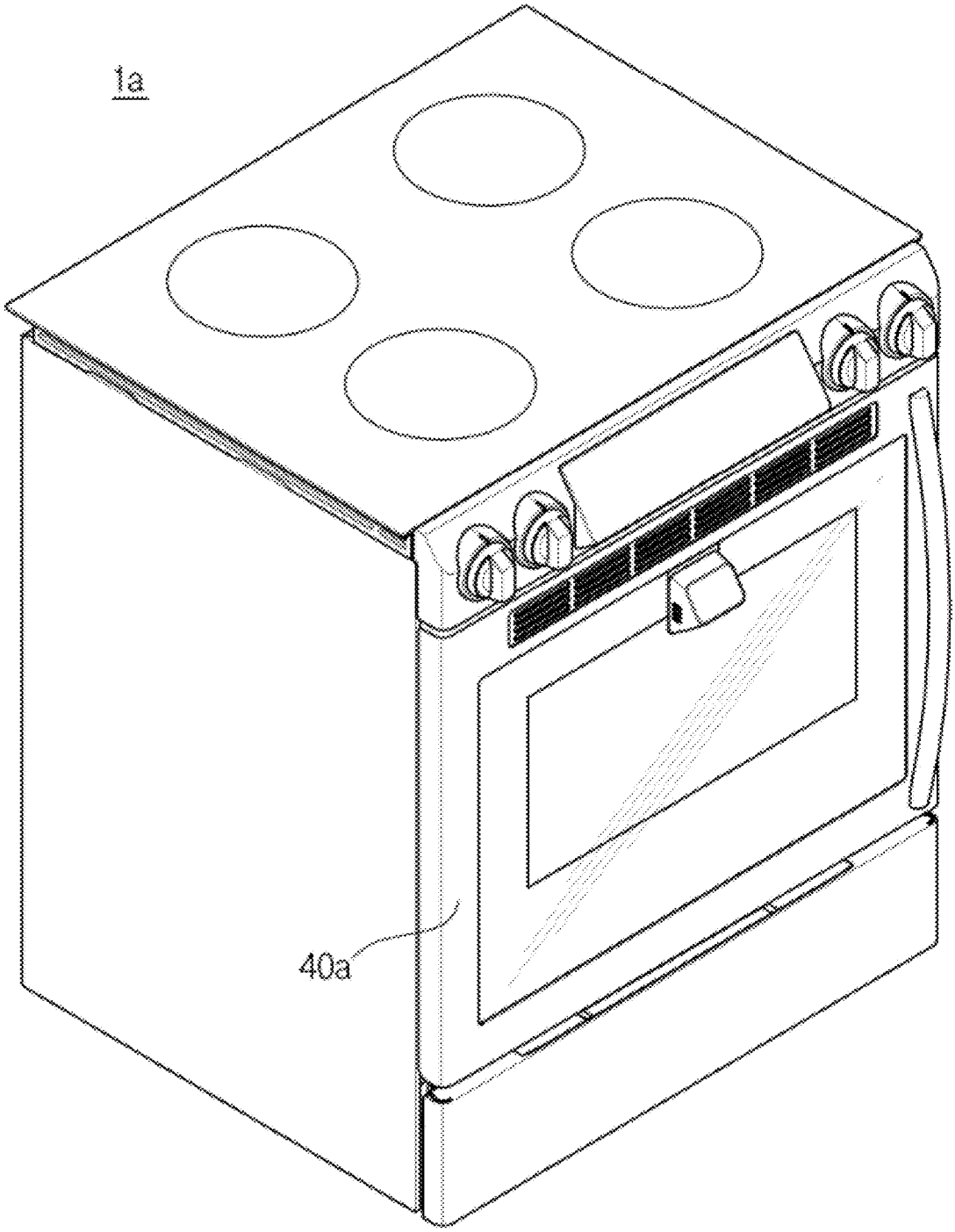
FIG. 18 is a perspective view of an oven, according to another embodiment of the present disclosure.
Figure 19:
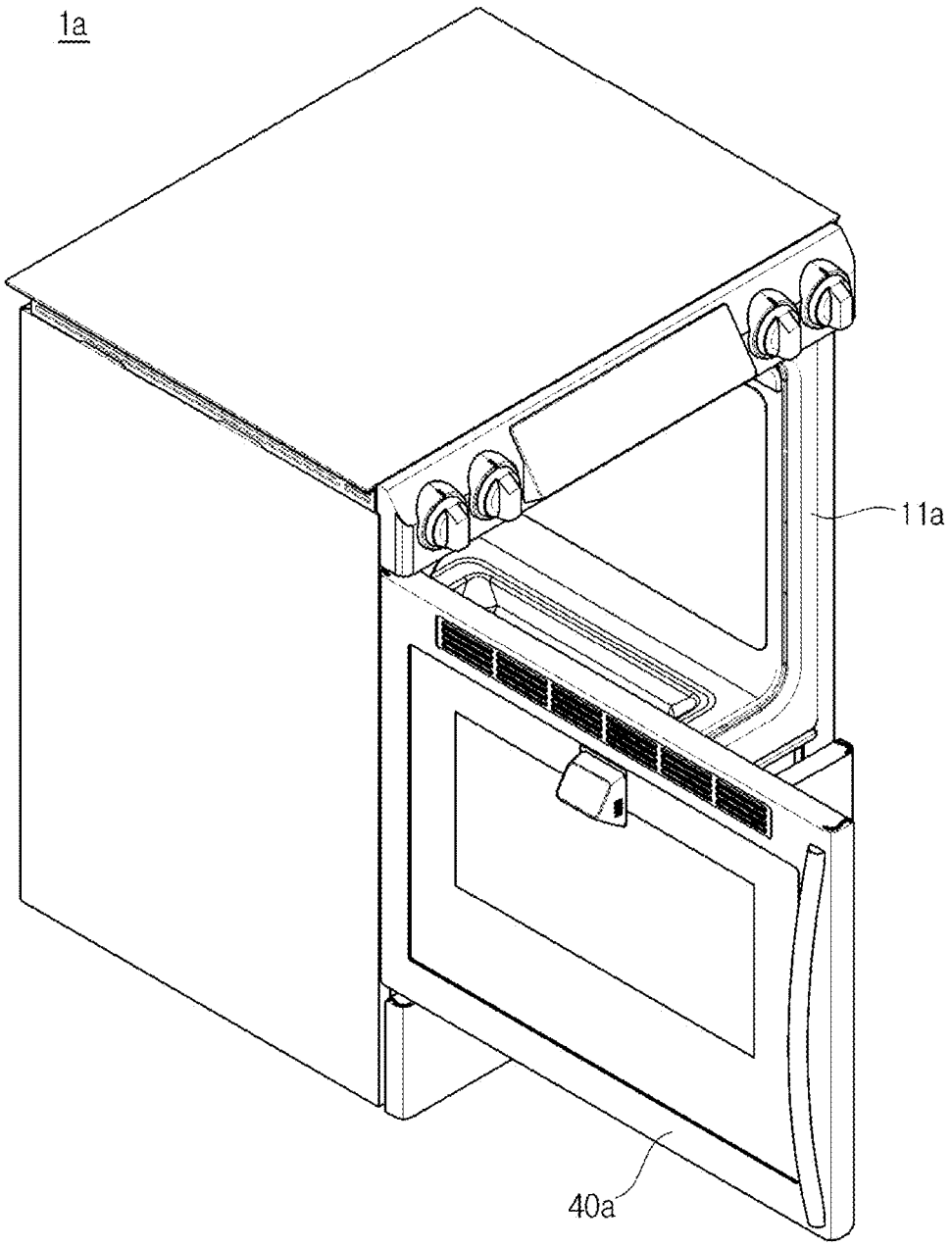
FIG. 19 is a view with a door of an oven open, according to another embodiment of the present disclosure.
Figure 20:
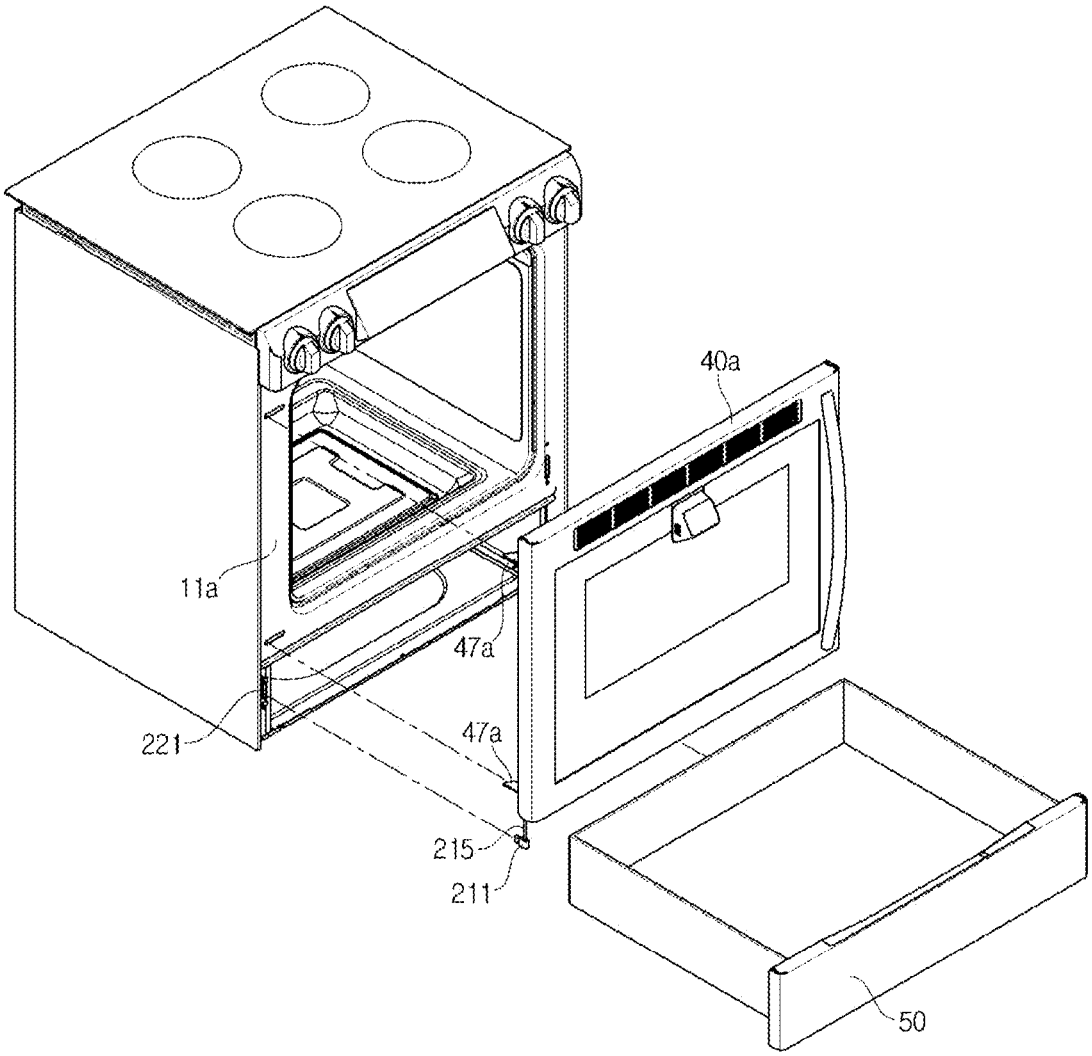
FIG. 20 is a front view of an oven with a storage room removed, according to another embodiment of the present disclosure.

FIG. 18 is a perspective view of an oven, according to another embodiment of the present disclosure, FIG. 19 is a view with a door of an oven open, according to another embodiment of the present disclosure, and FIG. 20 is a front view of an oven with a storage room removed, according to another embodiment of the present disclosure.

As shown in FIGS. 18 and 19, the oven 1*a* may include a door 40*a* provided to open or close the opening 12 of the cooking room 20 to the left or right.

On the rear side of the door 40*a*, there may be a hinge 47*a* provided for the door 40*a* to be pivoted against the case 10. The hinge 47*a* is provided on the rear left or right of the door 40*a*, allowing the door 40*a* to be pivoted to a side against the case 10.

A hinge recess may be provided on the corresponding side of a front panel 11*a* to the hinge 47*a*, such that the hinge 47*a* may be inserted and pivotally fixed thereto and may be separated therefrom.

The hinge recess may be provided on the left or right of the front panel 11*a* to correspond to the hinge 47*a*.

The first cable 210 passing through the inside of the door 40*a* and extending to be exposed to the outside under the door 40*a* may extend down the door 40*a* to provide the decoupling portion 230 at a position corresponding to the height of the storage room 50 as in the embodiment of the present disclosure.

Accordingly, to separate the door 40*a* from the case 10 as shown in FIG. 20, the storage room 50 should be slid open to expose the decoupling portion 230 and then the first cable 210 and the second cable 220 should be separated.

The decoupling portion 230 may be provided substantially perpendicular to the direction in which the door 40*a* is pivoted, and may thus interfere with the pivoting of the door 40*a*.

Accordingly, the exposure portion 215 having the decoupling portion 230 located therein and extending to the outside of the door 40*a* may be arranged to be adjacent to the pivotal axis of the door 40*a* not to interfere with pivoting of the door 40*a*.

A coupling structure of the cable 200 in accordance with another embodiment of the present disclosure will now be described. Other configurations of an oven 1*b* than the configurations which will be described below are the same as those in the previous embodiment, so the description thereof will be omitted.

Figure 21:
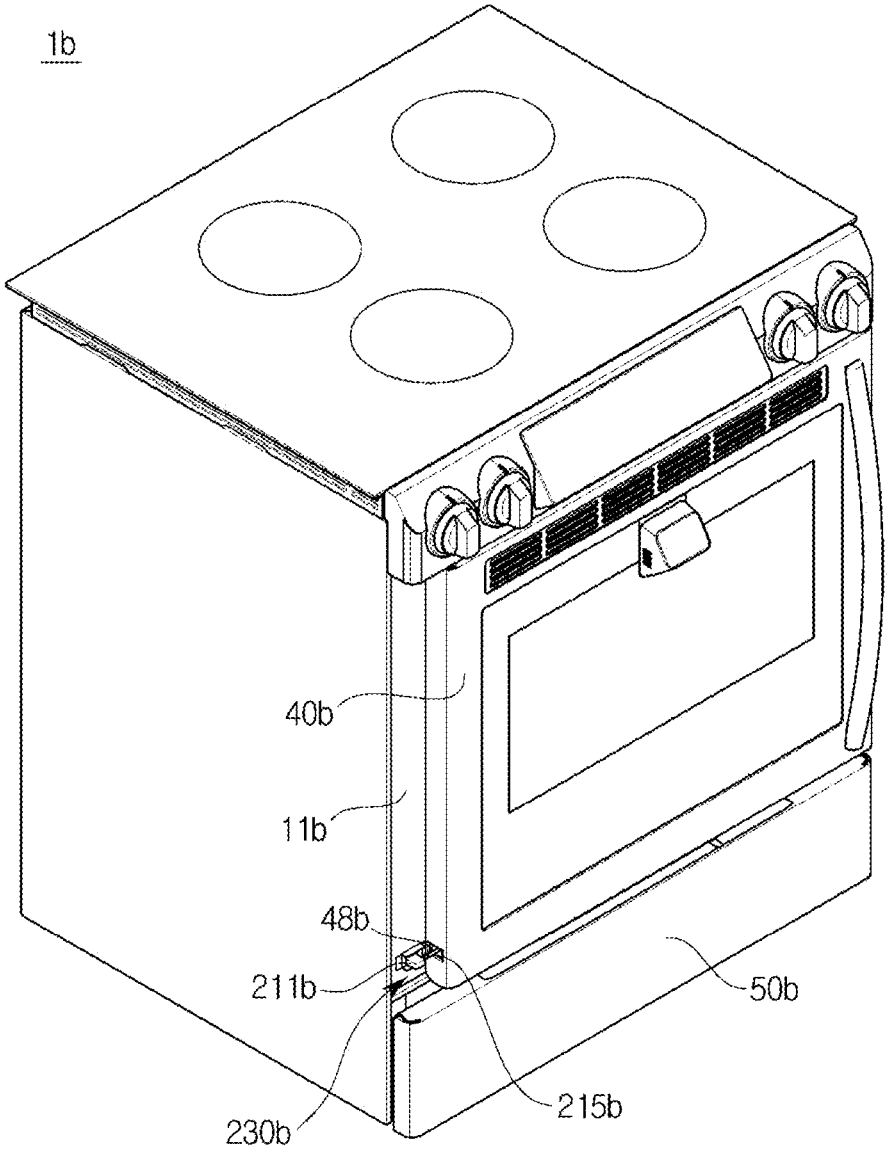
FIG. 21 is a perspective view of an oven, according to another embodiment of the present disclosure.
Figure 22:
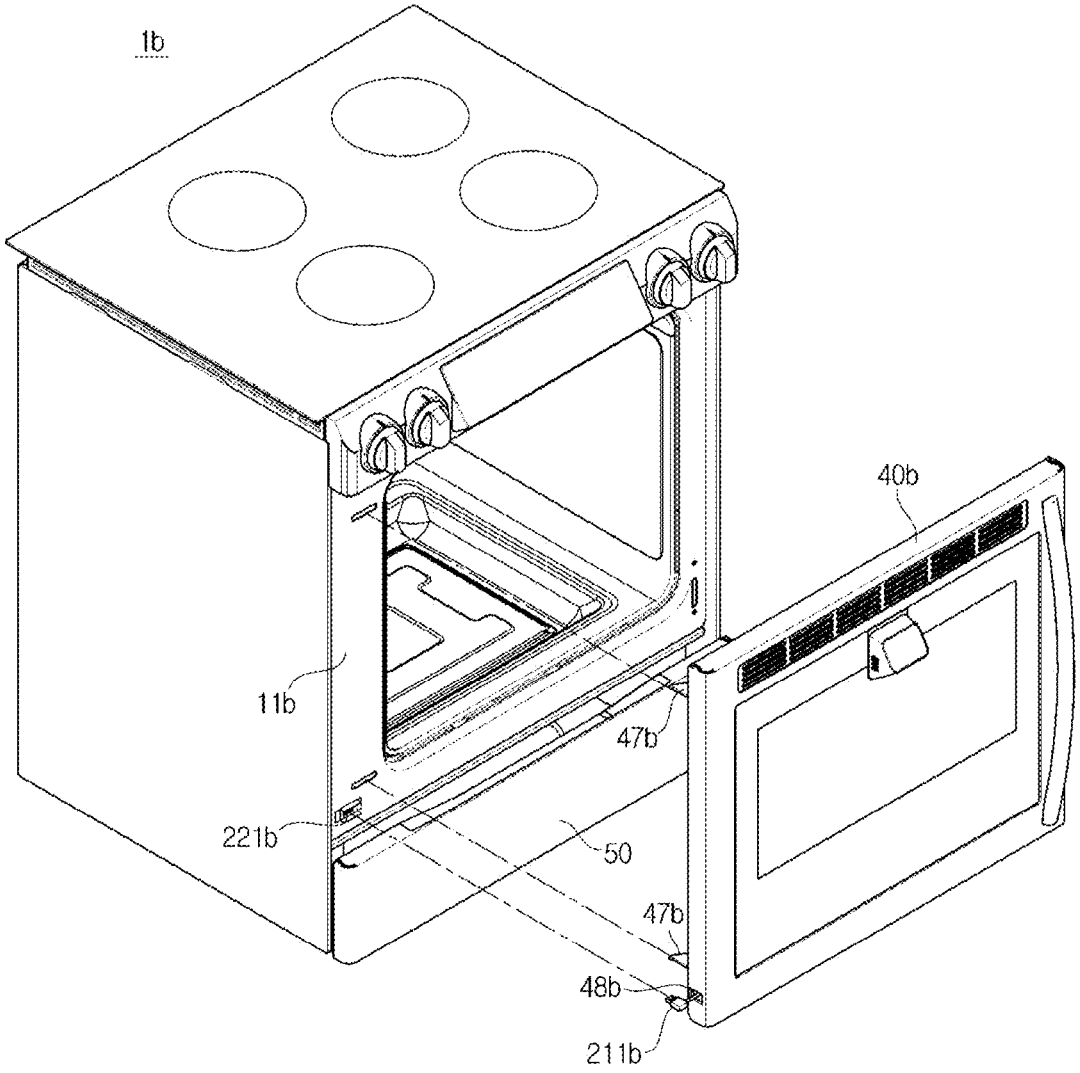
FIG. 22 is a view of an oven with the door separated therefrom, according to another embodiment of the present disclosure.

FIG. 21 is a perspective view of an oven, according to another embodiment of the present disclosure, and FIG. 22 is a view of an oven with the door separated therefrom, according to another embodiment of the present disclosure.

As shown in FIG. 21, the oven 1*b* may include a door 40*b* provided to open or close the opening 12 of the cooking room 20 to the left or right. The cross width of the door 40*b* may be shorter than the cross width of the case 10.

Specifically, an end adjacent to the pivotal axis of the door 40*b* may be shorter than the cross end of the case 10, and the other end of the door 40*b* may correspond to the other cross end of the case 10.

On the outside of the end of the door 40*b*, a side of the front panel 11*b* may be exposed to the outside of the oven 1*b*.

A first cable 210*b* may include an exposure portion 215*b* extending outward from a side adjacent to the pivot axis of the door 40*b*. Unlike the aforementioned embodiments of the present disclosure, the exposure portion 215*b* may be formed to bore through the side of the door 40*b* to be exposed to the outside.

Accordingly, the decoupling portion 230*b* may be located not under the door 40*b* but to a side of the door 40*b*. Specifically, the decoupling portion 230*b* may be provided on the outside in a direction of the side of the door 40*b* and located on the exposed side of the front panel 11*b*.

Specifically, a first coupler 211*b* and a second coupler 221*b* may be provided on the exposed front panel 11*b* to be coupled and decoupled, and may be placed between a side portion of the door 40*b* and a corresponding position.

Since the first coupler 211*b* and the second coupler 221*b* are located on an outer side adjacent to the pivotal axis of the door 40*b*, they may interfere with pivoting of the door 40*b* because the first coupler 211*b* is located within the pivotal radius of the door 40*b* while the door 40*b* is pivoting.

That is, while the door 40*b* is pivoting, it may be restricted because the first coupler 211*b* may contact a side of the door 40*b*.

To prevent this, an insertion hole 48*b* may be provided at a position adjacent to the first coupler 211*b* for the first coupler 211*b* to be inserted to the inside of the door 40*b* to avoid the interference with pivoting of the door 40*b* while the door 40*b* is pivoting.

The insertion hole 48*b* may be formed in a portion of a side of the door 40*b* and may have a size corresponding to the size of the first coupler 211*b*. Furthermore, the exposure portion 215*b* of the first cable 220*b* may extend to the outer side of the door 40*b* through the insertion hole 48*b*.

As shown in FIG. 22, when the door 40*b* is separated from the case 10, unlike the aforementioned embodiments, the user may directly pull the exposed first coupler 211*b* to separate the cable 200 and may then separate the door 40*b* without need to open the storage room 50.

A coupling structure of the cable 200 in accordance with another embodiment of the present disclosure will now be described. Other configurations of an oven 1*c* than the configurations which will be described below are the same as those in the previous embodiment, so the description thereof will be omitted.

Figure 23:
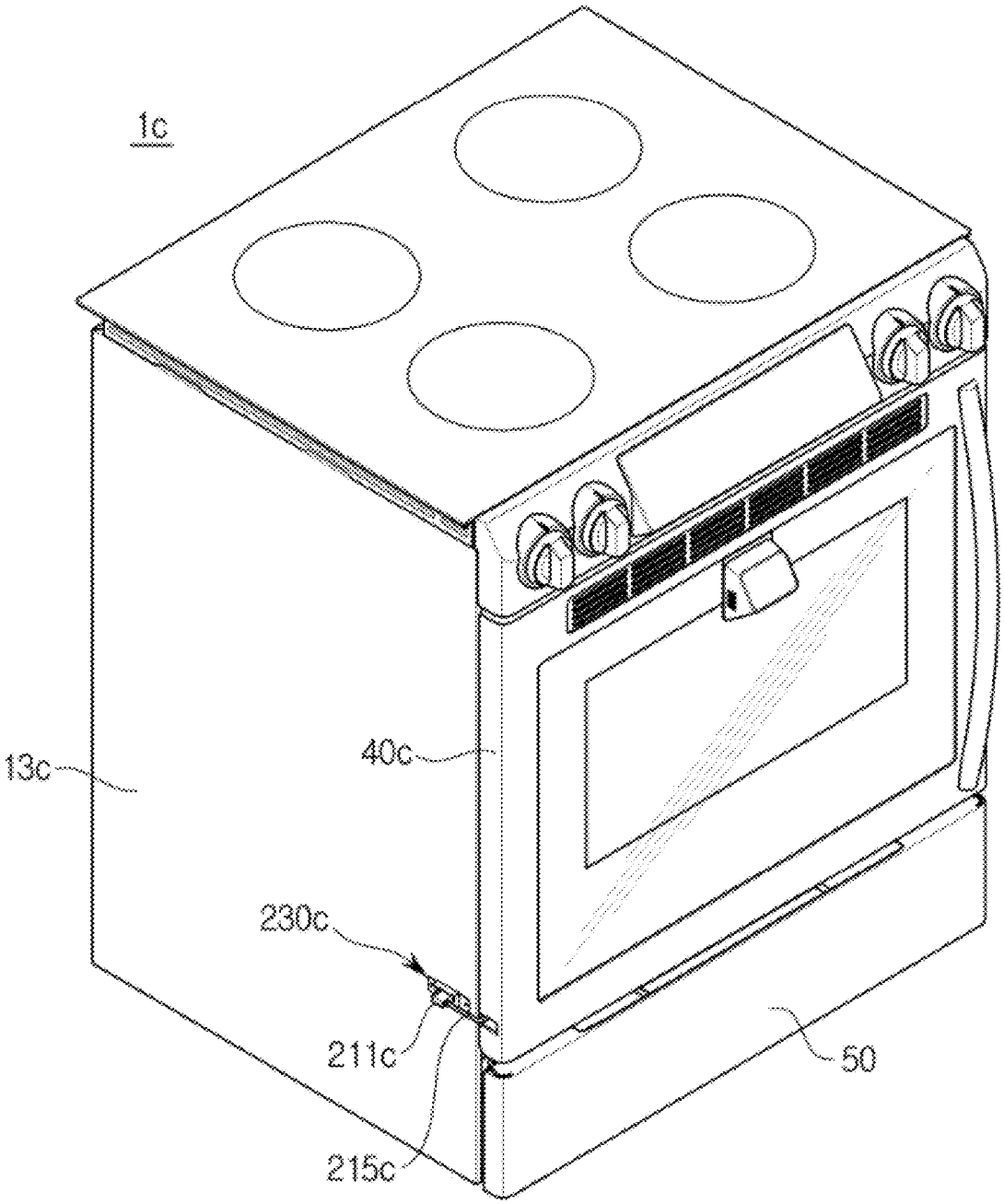
FIG. 23 is a perspective view of an oven, according to another embodiment of the present disclosure.

As shown in FIG. 23, a decoupling portion 230*c* of the cable 200 may be provided on a side panel 13*c* of the case 10.

Specifically, the first cable 210*c* may include an exposure portion 215*c* extending outward from a side adjacent to the pivot axis of the door 40*c*. The exposure portion 215*c* may be formed to bore through the side of the door 40*b* and extend to the side panel 13*c*.

Accordingly, the decoupling portion 230*c* may be located not under the door 40*b* but to a side of the door 40*b*, and may be located not on the front of the oven 1*c* but on the side. Specifically, the decoupling portion 230*c* may be formed outward from the side of the door 40*c*, and may extend from the front of the oven 1*c* to be located on the side panel 13*c*.

Accordingly, when the door 40*b* is separated from the case 10, the user may directly pull the first coupler 211*c* located on the exposed side panel 13*c* to separate the cable 200 and may then separate the door 40*b* from the case 10 without need to open the storage room 50.

A coupling structure of the cable 200 in accordance with another embodiment of the present disclosure will now be described. Other configurations of an oven 1*d* than the configurations which will be described below are the same as those in the previous embodiment, so the description thereof will be omitted.

Figure 24:
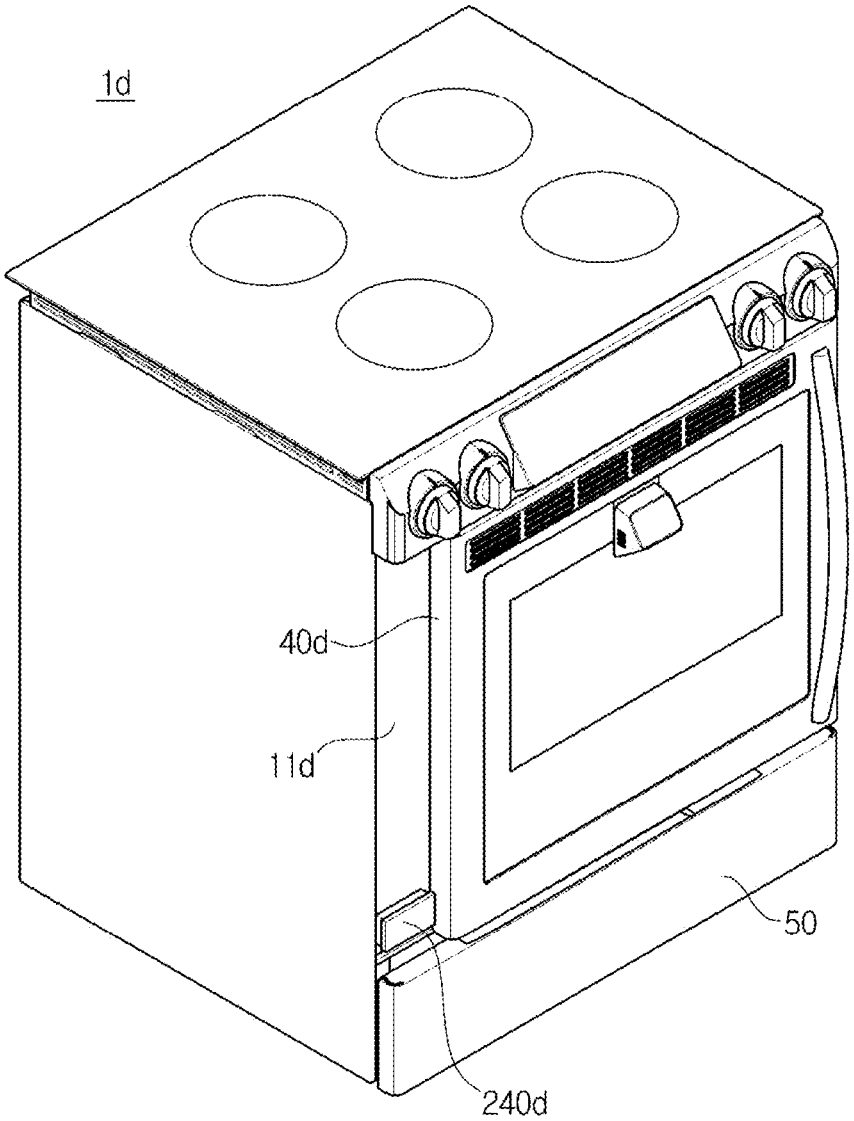
FIG. 24 is a perspective view of an oven, according to another embodiment of the present disclosure.
Figure 25:
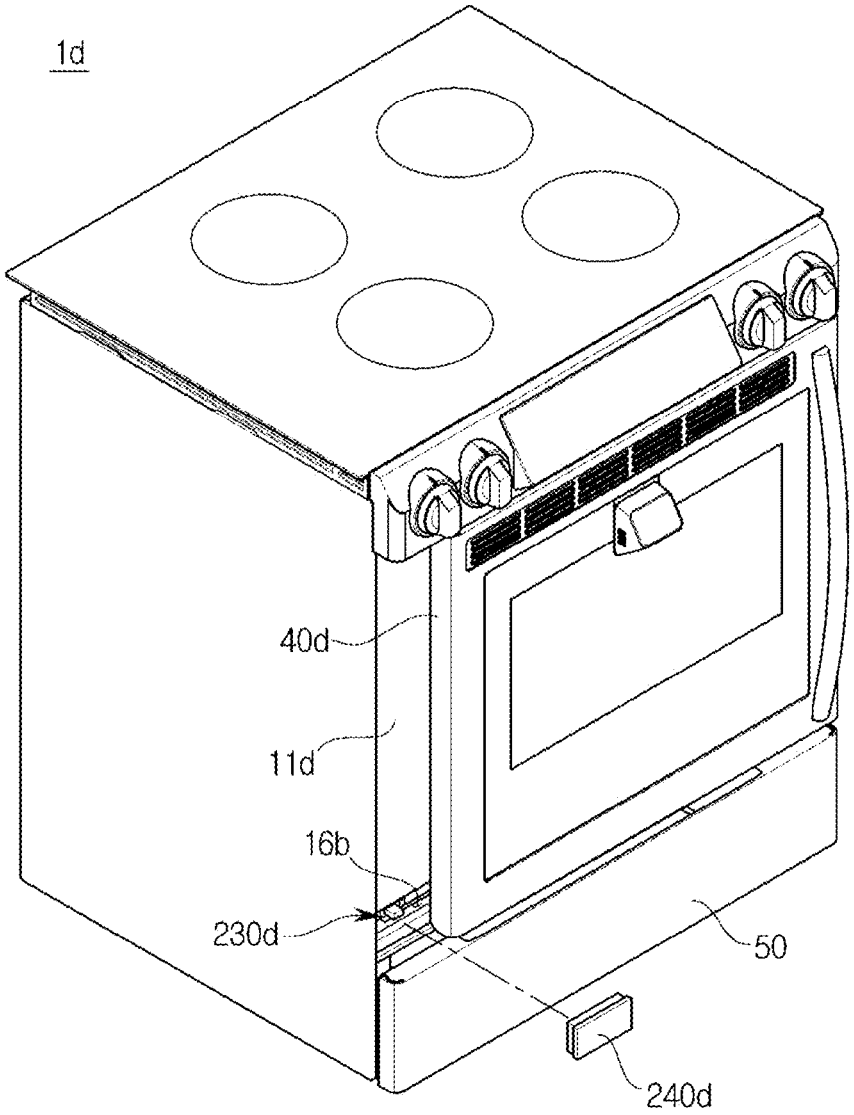
FIG. 25 is a perspective view of an oven with some components separated therefrom, according to another embodiment of the present disclosure.
Figure 26:
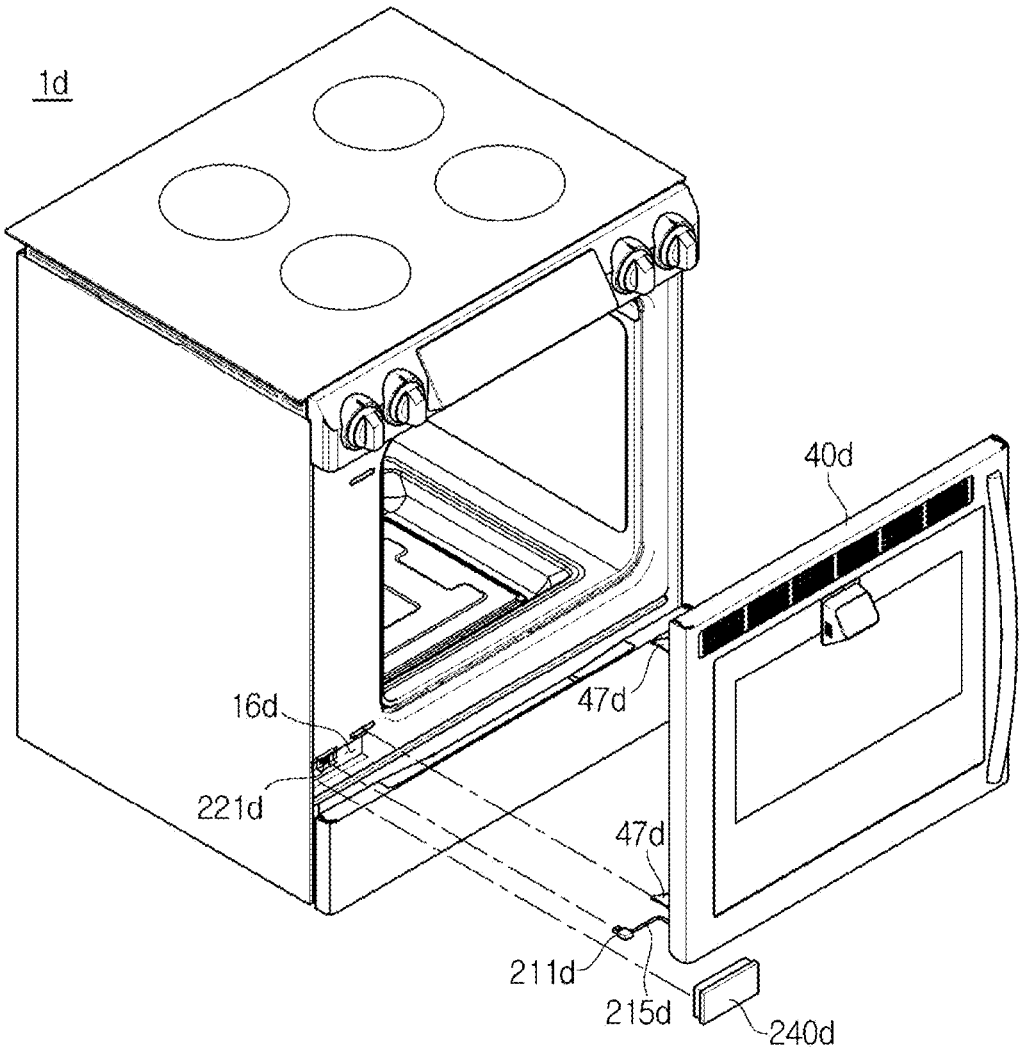
FIG. 26 is a perspective view of an oven with some components separated therefrom, according to another embodiment of the present disclosure.

FIG. 24 is a perspective view of an oven, according to another embodiment of the present disclosure, FIG. 25 is a perspective view of an oven with some components separated therefrom, according to another embodiment of the present disclosure, and FIG. 26 is a perspective view of an oven with some components separated therefrom, according to another embodiment of the present disclosure.

As shown in FIGS. 24 and 25, the oven 1*d* may include a door 40*d* provided to open or close the opening 12 of the cooking room 20 to the left or right. The cross width of the door 40*d* may be shorter than the cross width of the case 10.

Specifically, an end adjacent to the pivotal axis of the door 40*d* may be shorter than the cross end of the case 10, and the other end of the door 40*d* may correspond to the other cross end of the case 10.

On the outside of the end of the door 40*d*, a side of a front panel 11*d* may be exposed to the outside of the oven 1*d*.

A first cable 210*d* may include an exposure portion 215*d* extending outward from a side adjacent to the pivot axis of the door 40*d*. An exposure portion 215*d* may bore through the rear portion of the door 40*d* and extend to a side of the door 40*d* to be exposed.

Accordingly, a decoupling portion 230*d* may be located not under the door 40*d* but to a side of the door 40*d*. Specifically, the decoupling portion 230*d* may be provided on the outside in a direction of the side of the door 40*d* and located on the exposed side of the front panel 11*d*.

Specifically, a first coupler 211*d* and a second coupler 221*d* may be provided on the exposed front panel 11*d* to be coupled and decoupled, and may be placed between a side portion of the door 40*d* and a corresponding position.

Since the first coupler 211*d* and the second coupler 221*d* are located on the outside adjacent to the pivotal axis of the door 40*d*, they may interfere with pivoting of the door 40*d* because the first coupler 211*d* is located within the pivotal radius of the door 40*d* while the door 40*d* is pivoting.

That is, while the door 40*b* is pivoting, it may be limited because the first coupler 211*d* may contact a side of the door 40*d*.

To prevent this, the decoupling portion 230*d* may be formed on the front panel 11*d* and located in an insertion portion 16*d* concavely formed toward the back of the oven 1*d*.

The insertion portion 16*d* may be recessed on the front panel 11*d* toward the inner side of the case 10 to form the space having a gap with the front side of the front panel 11*d*.

The distance between the insertion portion 16*d* and the front side of the front panel 11*d* may be preferably larger than the thickness of the door 40*d*. This is to place the exposure portion 215*d* of the first cable 210*d* boring through the rear side of the door 40*d* and extending outward on the inner side of the insertion portion 16*d*.

The exposure portion 215*d* is formed on the inner side of the space of the insertion portion 16*d*, and the decoupling portion 230*d* is located on the front of the insertion portion 16*d*, so that when the door 40*d* is opened, the exposure portion 215*d* or the first coupler 211*d* may be at a distance from the pivotal radius of the door 40*d*.

Accordingly, the exposure portion 215*d* and the first coupler 211*d* may be arranged not to interfere with opening of the door 40*d*.

There may be a cover member 240*d* provided on the front of the insertion portion 16*d* to cover the insertion portion 16*d*. The cover member 240*d* may have the size corresponding to the front of the insertion portion 16*d* and may be located to be separable from the insertion portion 16*d*.

With the cover member 240*d*, the aesthetic appearance of the front of the oven 1*d* may be constantly maintained and separation of the cable 200 by an arbitrary force applied to the decoupling portion 230*d* may be prevented.

As shown in FIG. 25, when the door 40*d* is separated from the case 10, the user may separate the cover member 240*d*, then pull the exposed first coupler 211*d* to separate the cable 200 and then the door 40*d* without need to open the storage room 50.

A coupling structure of the cable 200 in accordance with another embodiment of the present disclosure will now be described. Other configurations of an oven 1*e* than the configurations which will be described below are the same as those in the previous embodiment, so the description thereof will be omitted.

Figure 27:
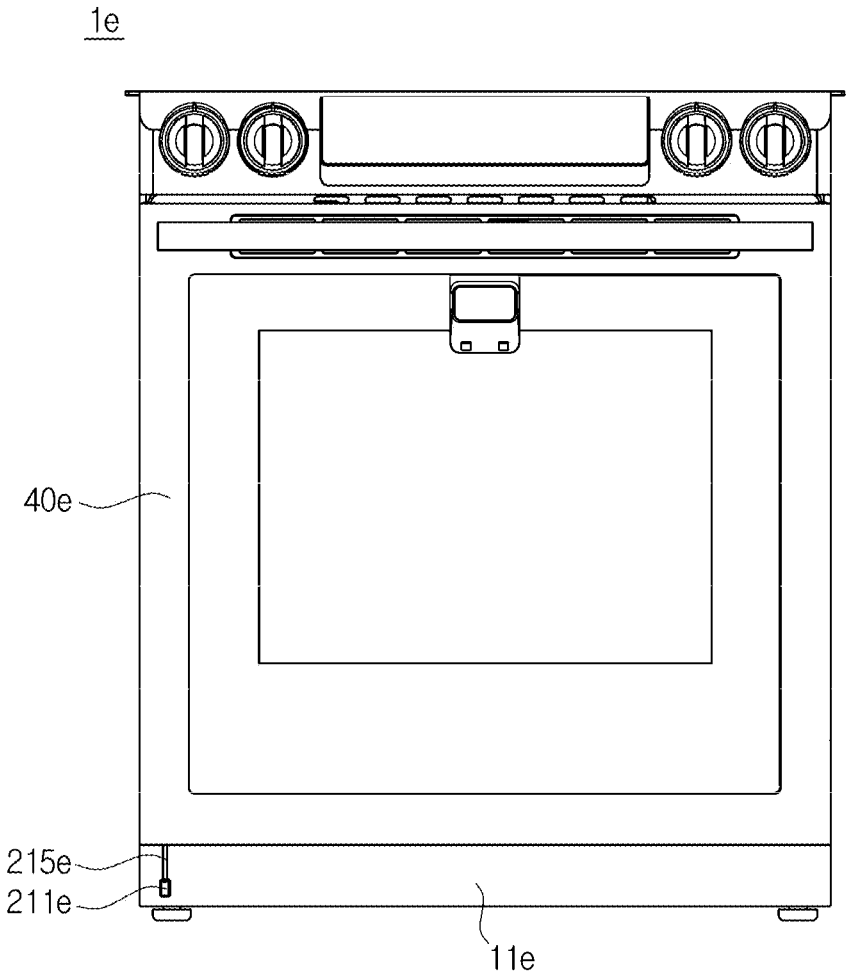
FIG. 27 is a front view of an oven, according to another embodiment of the present disclosure.
Figure 28:
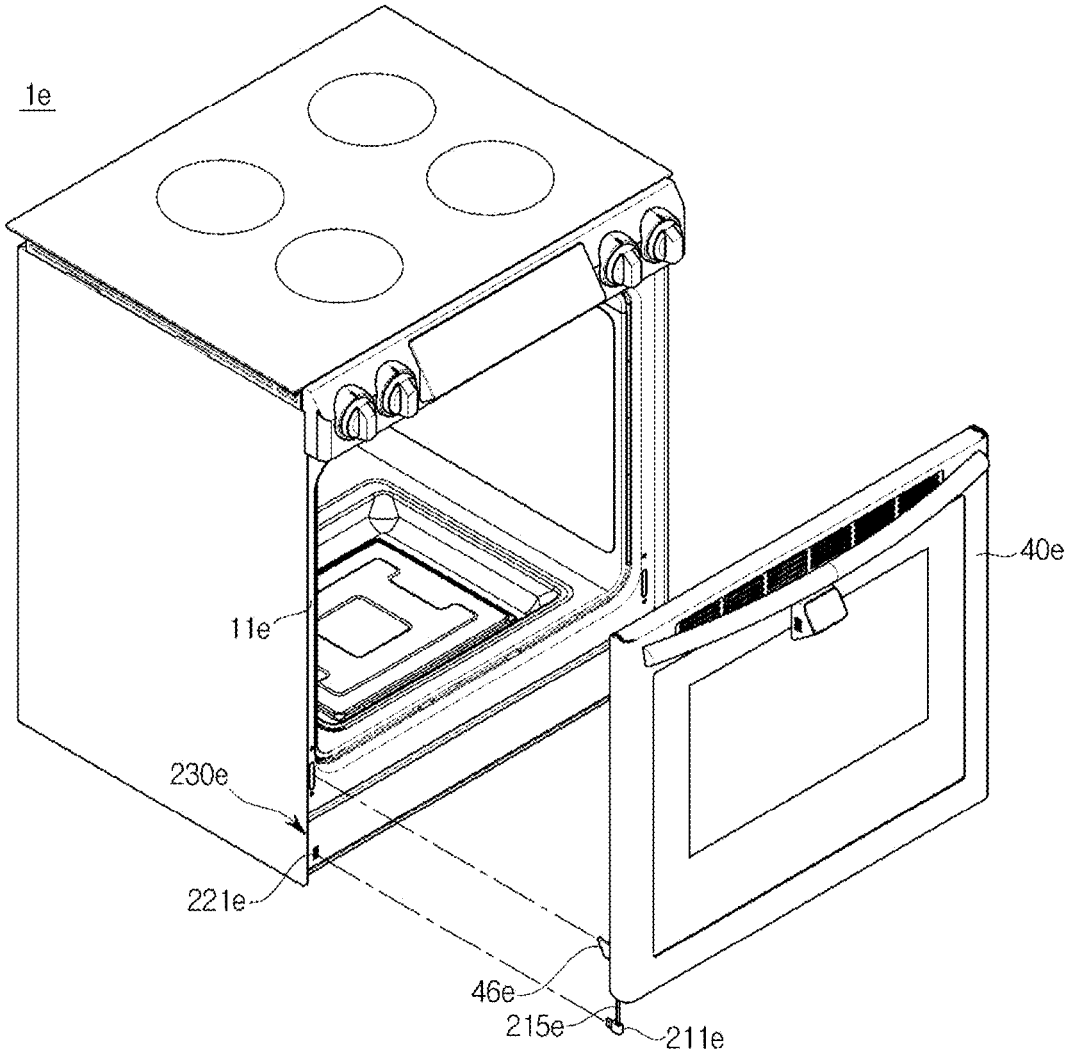
FIG. 28 is a view of an oven with the door separated therefrom, according to another embodiment of the present disclosure.

FIG. 27 is a perspective view of an oven, according to another embodiment of the present disclosure, and FIG. 28 is a view of an oven with the door separated therefrom, according to another embodiment of the present disclosure.

In this embodiment, the storage room 50 may not be included unlike the aforementioned embodiments. Accordingly, the cooking room 20 may expand even to the space where the storage room 50 would otherwise be provided.

An exposure portion 215*e* may bore through the bottom side of a door 40*e* to be exposed, and a decoupling portion 230*e* may be provided on the outer side of the bottom of the door 40*e*.

Specifically, the decoupling portion 230*e* may be located on an exposed front pane 1*e* under the door 40*e*. Accordingly, a first coupler 211*e* and a second coupler 221*e* may be provided on the front panel 11*e* to be coupled and decoupled.

To prevent interference of the first coupler 211*e* while the door 40*e* is pivoting, the door 40*e* may have an insertion hole 48*e* at a position corresponding to the first coupler 211*e*.

The insertion hole 48*b* may be formed in a lower portion of the door 40*e* and may have a size corresponding to the size of the first coupler 211*e*. Furthermore, the exposure portion 215*e* of the first cable 220*e* may extend to the outside of the door 40*e* through the insertion hole 48*e*.

To separate the door 40*e*, the user may pull the first coupler 211*e* located underneath the door 40*e* to separate the second coupler 221*e* and then separate the door 40*e* from the case 10.

A coupling structure of the cable 200 in accordance with another embodiment of the present disclosure will now be described. Other configurations of an oven if than the configurations which will be described below are the same as those in the previous embodiment, so the description thereof will be omitted.

Figure 29:
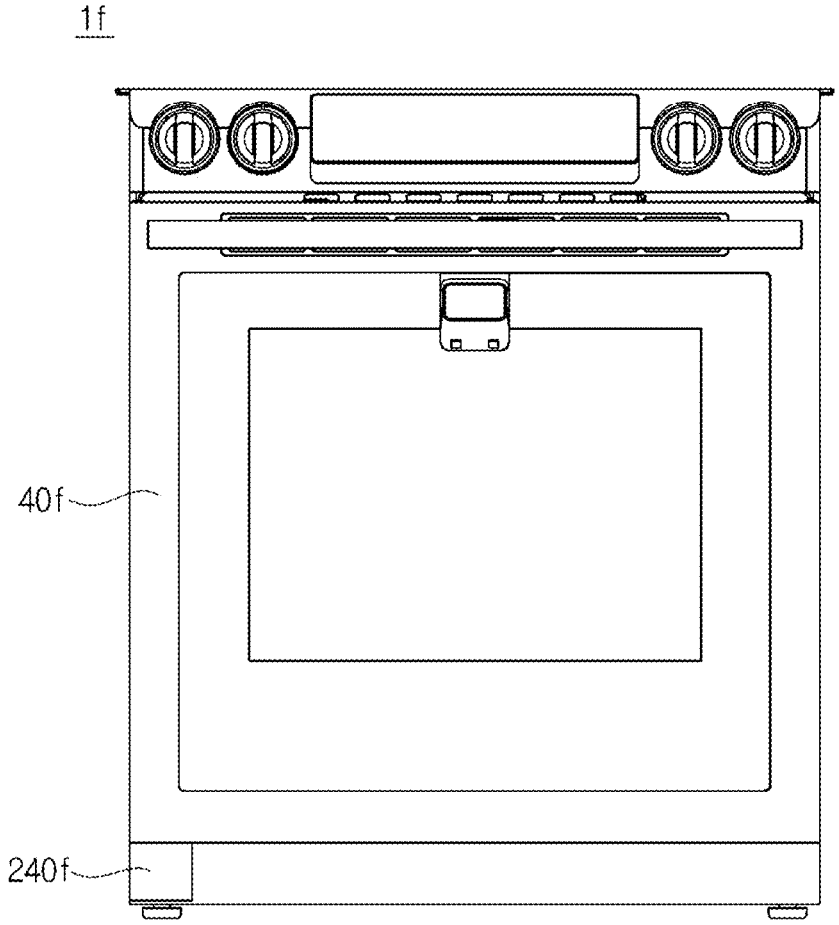
FIG. 29 is a front view of an oven, according to another embodiment of the present disclosure.
Figure 30:
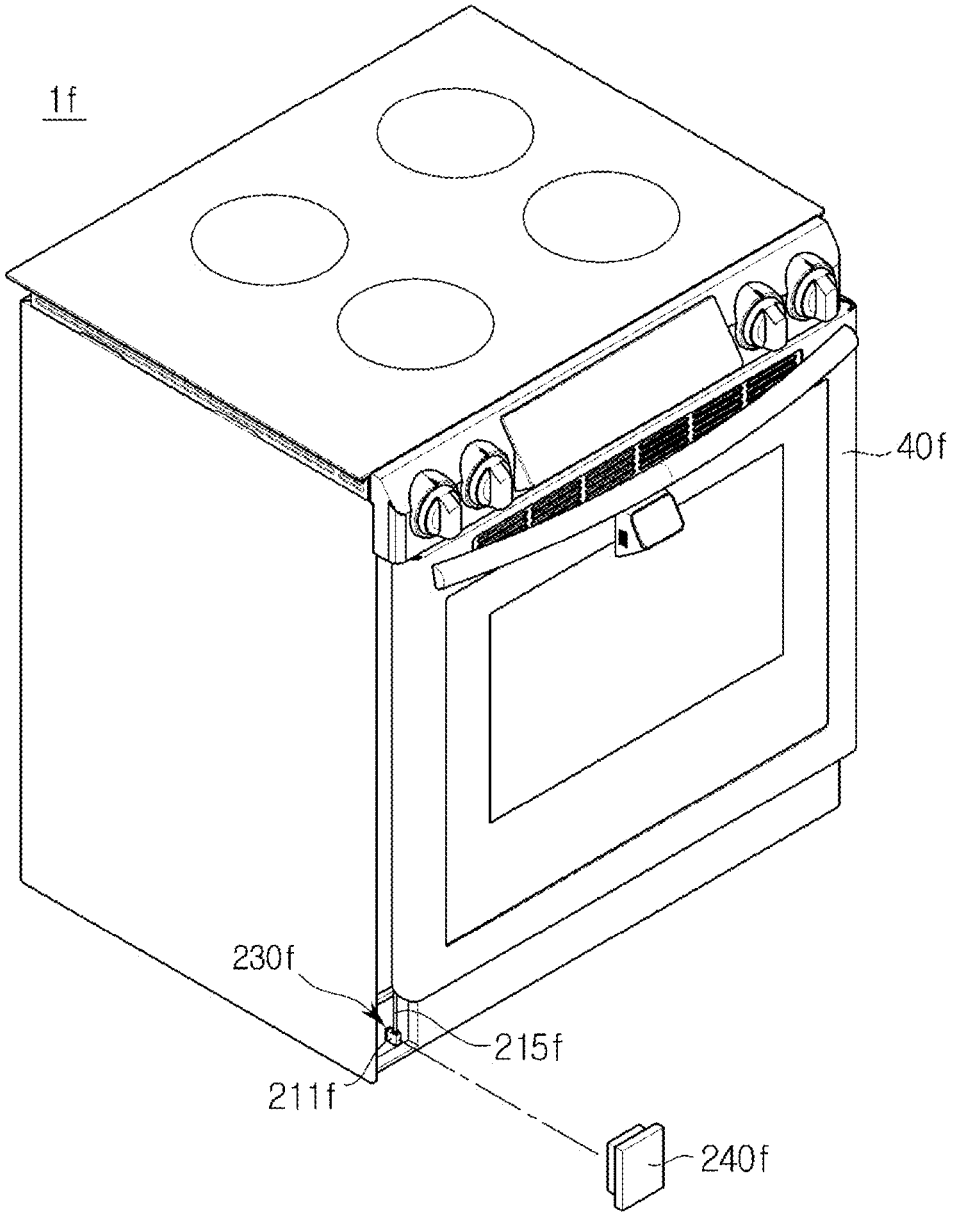
FIG. 30 is a perspective view of an oven with some components separated therefrom, according to another embodiment of the present disclosure.
Figure 31:
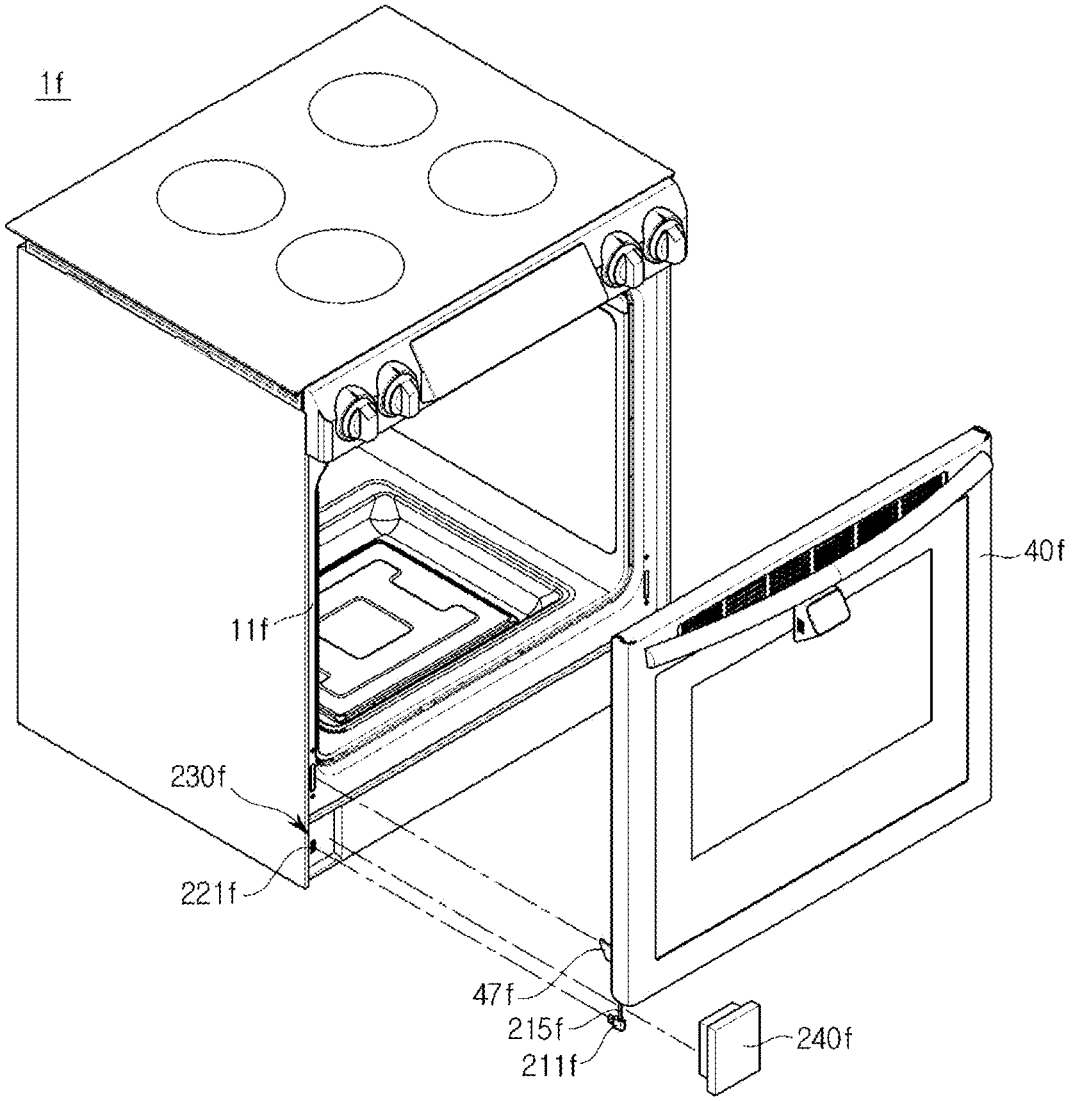
FIG. 31 is a perspective view of an oven with some components separated therefrom, according to another embodiment of the present disclosure.

FIG. 29 is a perspective view of an oven, according to another embodiment of the present disclosure, FIG. 30 is a perspective view of an oven with some components separated therefrom, according to another embodiment of the present disclosure, and FIG. 31 is a perspective view of an oven with some components separated therefrom, according to another embodiment of the present disclosure.

An insertion portion 16*f* may be formed in a lower portion of a door 40*f* in a concave form toward the inner side of the case 10. An exposure portion 215*f* boring through the bottom or rear side of the door 40*f* and extending downward from the door 40*f* may be located in the space formed by the insertion portion 16*f*.

Furthermore, the decoupling portion 230*f* is located on the front of the insertion portion 16*f*, so that when the door 40*f* is opened, the exposure portion 215*f* or a first coupler 211*f* may be at a distance from the pivotal radius of the door 40*f*. Accordingly, the exposure portion 215*f* and the first coupler 211*f* may be arranged not to interfere with opening of the door 40*f*.

There may be a cover member 240*f* provided on the front of the insertion portion 16*f* to cover the insertion portion 16*f*. The cover member 240*f* may have the size corresponding to the front of the insertion portion 16*f* and may be located to be separable from the insertion portion 16*f*. A procedure of the oven 1 transmitting/receiving information to/from an external device 1000 will now be described in detail.

Figure 32:
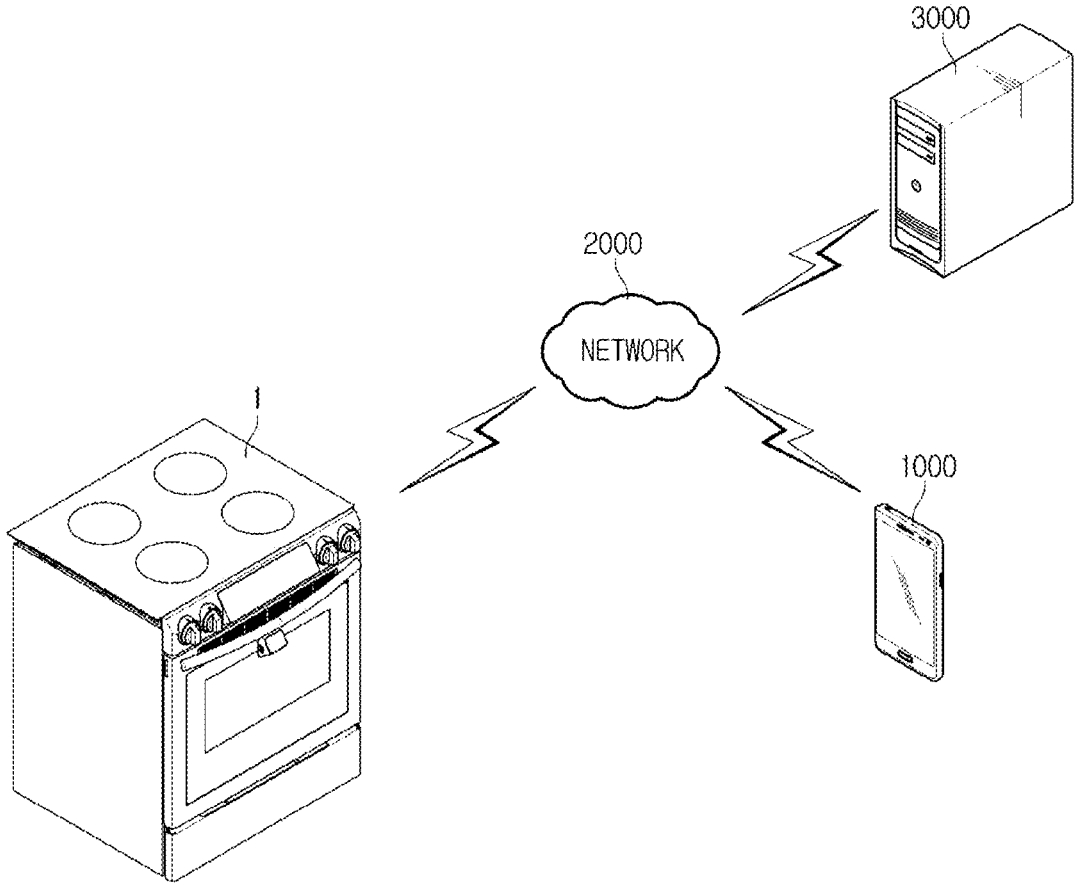
FIG. 32 schematically shows an oven in communication with an external device, according to an embodiment of the present disclosure.
Figure 33:
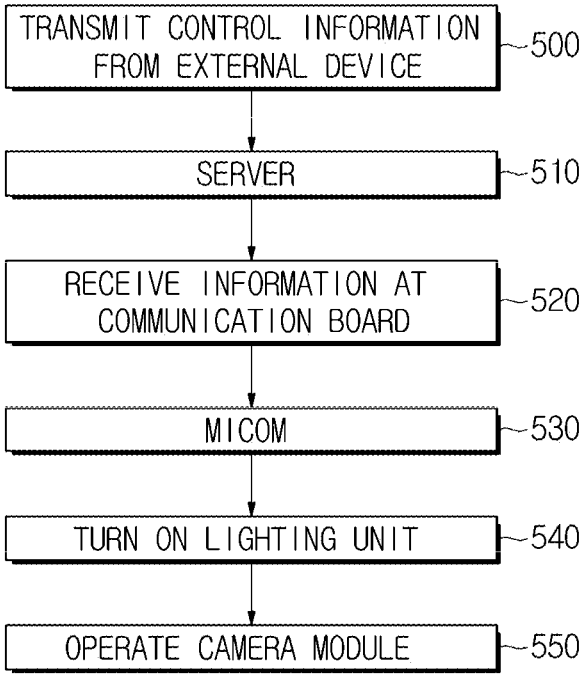
FIG. 33 is a stepwise diagram illustrating a state of an oven driven by receiving information from an external device, according to an embodiment of the present disclosure.
Figure 34:
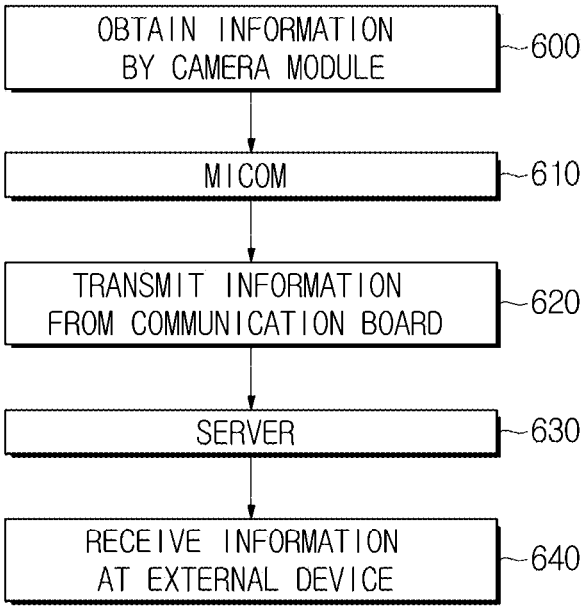
FIG. 34 is a stepwise diagram illustrating a state of an oven transmitting information to an external device, according to an embodiment of the present disclosure.

FIG. 32 schematically shows an oven in communication with an external device, according to an embodiment of the present disclosure, FIG. 33 is a stepwise diagram illustrating a state of an oven driven by receiving information from an external device, according to an embodiment of the present disclosure, and FIG. 34 is a stepwise diagram illustrating a state of an oven transmitting information to an external device, according to an embodiment of the present disclosure.

The oven 1 may send/receive information to/from the external device 1000 through the monitoring unit 100 over a communication network 2000.

Generally, the external device 1000 may be a mobile device, such as a smart phone, a tablet phone, a cell phone, a PDA, a laptop, a media player, a GPS and other image display device, and may be various kinds of home appliances and other electronic products capable of communication over a network. In an embodiment of the present disclosure, the external device 1000 is assumed to be a smart phone, for example, without being limited thereto.

The network 2000 may be implemented with a wired network such as Local Area Network (LAN), Wide Area Network (WAN), Value Added Network (VAN), etc., or a wireless network such as a mobile radio communication network, a Near Field Communication network (NFC) network, satellite communication network, etc. Furthermore, it may be a data communication network in a comprehensive sense that ensures better communications between the respective network entities shown in FIG. 32, and may include the wired Internet, the wireless Internet, and a mobile radio communication network.

A procedure in which the monitoring unit 100 is driven by the external device 1000 begins by the external device 1000 transmitting information using a program, e.g., an app, over the network 2000, in 500.

The user may send control information for the monitoring unit 100 to take an image of the inside of the cooking room 20 through the external device 1000 with an app over the network 2000.

The information transmitted over the network 2000 may be received by a server 3000 over the network 2000, in 510.

Device information about the user's external device 1000 and the oven 1 should be pre-registered in the server 3000. With the registration, the external device 1000 has the authority to control the oven 1 whose device information has been registered by using a control means, such as an app.

According to the stored device information, the server 3000 may send the information received from the registered external device 1000 to the registered oven 1.

After that, information transmitted from the server 3000 may be received by the communication board 120 of the monitoring unit 100, in 520.

The communication board 120 may transmit/receive information in the form of Wi-Fi or data transmission, as described above.

After that, the information received by the communication board 120 is sent to the micom 300 for controlling the monitoring unit 100, 530.

The information received by the communication board 120 may be forwarded to the micom 300 via the cable 200, or forwarded to the micom 300 by a wireless communication network or other data transmission scheme.

If the user sends control information to drive the monitoring unit 100 through the external device 1000, the micom 300 first controls a lighting part (not shown) provided in the cooking room 20, in 540. Specifically, for better imaging by the camera module 110, the lighting part is turned on.

After the lighting part is turned on and a certain period of time has passed, the micom 300 may drive the camera module 110, in 550.

The user may selectively send a request for an image of the inside of the cooking room 20, a plurality of images sequentially captured, or video information through the external device 1000. Accordingly, the control information is selectively received from the external device 1000 and based on the received information, the micom 300 may drive the camera module 110.

The camera module 110 may be driven under the control of the micom 300, and acquire information by capturing the inside of the cooking room 20. In acquiring the information by the camera module 110, in 600, information corresponding to what is requested by the user under the control of the micom 300 is acquired as described above.

After that, driving of the camera module 110 may be stopped and information about the end of the driving may be sent to the micom 300, in 610.

The micom 300 controls the communication board 120 to send information collected by the camera module 110 over the network 2000, in 620.

The information over the network 2000 is sent back to the server 3000, and according to the device information stored in the server 3000, the server 3000 sends the information sent from the communication board 120 to the external device 1000, in 630.

The information sent from the server 3000 is received by the external device 1000 over the network 2000, in 640, so that the user is able to monitor the look of the inside of the cooking room 20 through an app provided in the external device 1000.

The external device 1000 may not only control driving the camera module 110 but also see the image of the cooking room sent by the camera module 110 and send control information to control the cooking condition of the oven 1.

Specifically, it may send control information to adjust the internal temperature of the cooking room 20 of the oven 1 or adjust cooking time to the oven 1, and the control information is received by the micom 300 through the communication board 120 via the server 3000 for the oven 1 to control the cooking condition according to the control information.

A display module 60*a* in accordance with another embodiment of the present disclosure will now be described. Other configurations of an oven 1 than the configurations which will be described below are the same as those in the previous embodiments, so the description thereof will be omitted.

Figure 35:
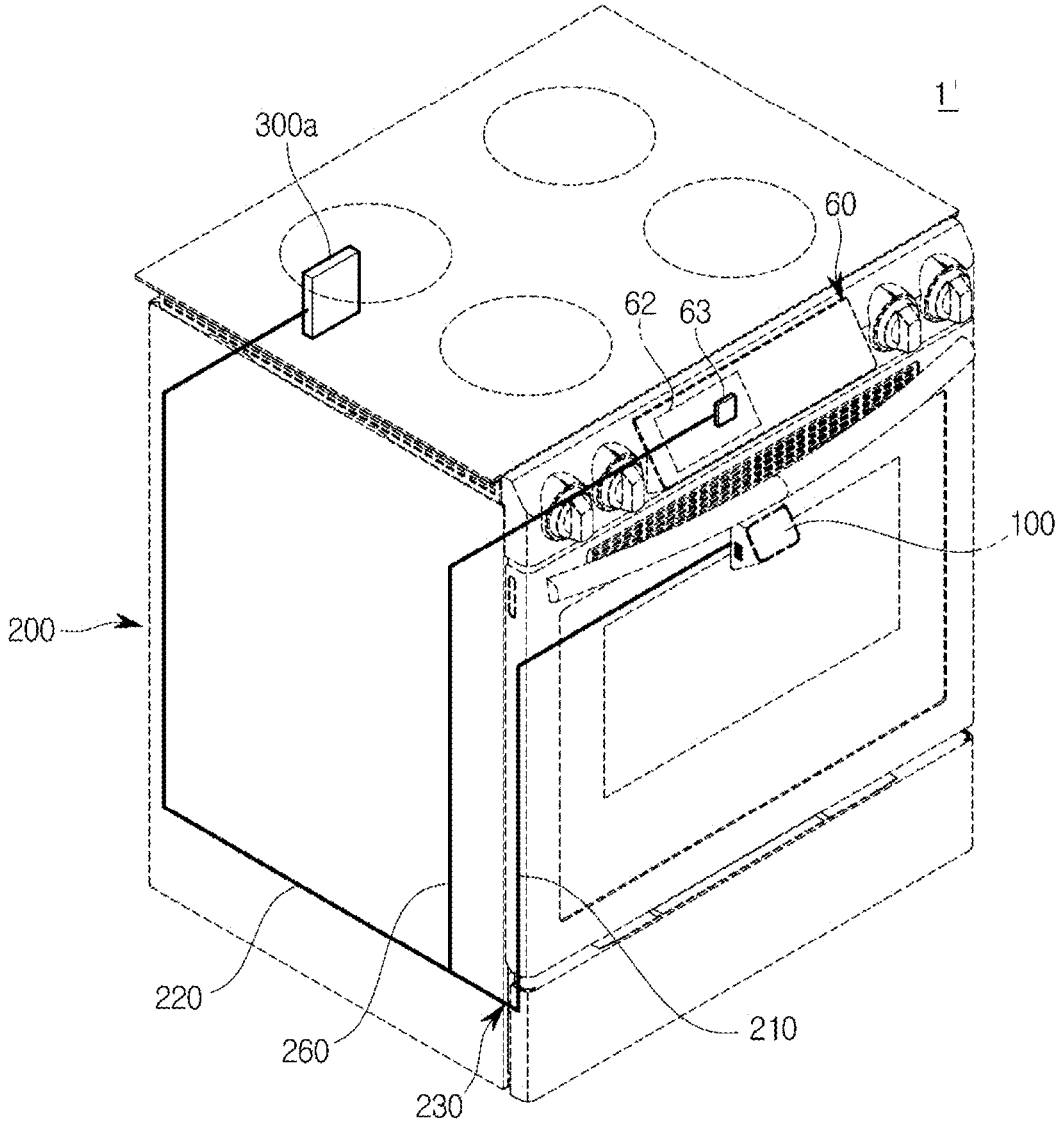
FIG. 35 is a perspective view of an oven, according to another embodiment of the present disclosure.
Figure 36:
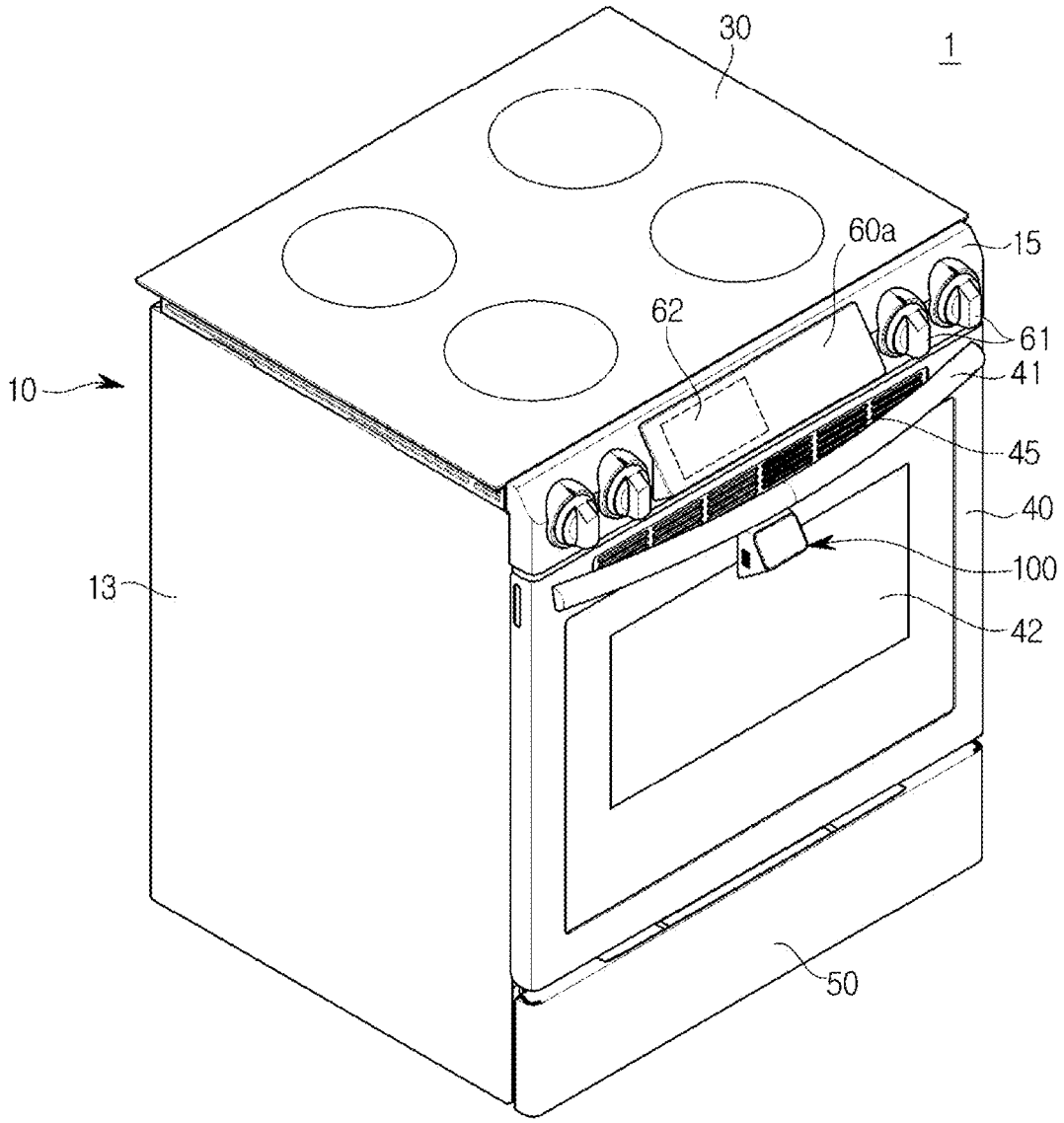
FIG. 36 shows a cable arranged on the inner side of a door, according to another embodiment of the present disclosure.
Figure 37:
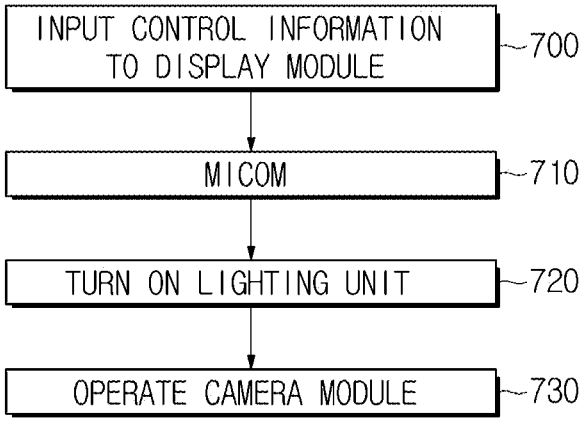
FIG. 37 is a stepwise diagram illustrating a stat of a monitoring unit driven when an oven receives information from a display module, according to another embodiment of the present disclosure.
Figure 38:
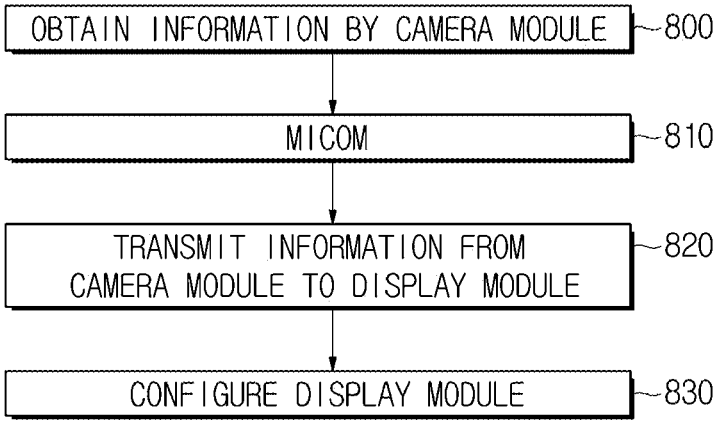
FIG. 38 is a stepwise diagram illustrating a state of displaying an image of a material on a display module of an oven, according to another embodiment of the present disclosure.

FIG. 35 is a perspective view of an oven, according to another embodiment of the present disclosure, FIG. 36 shows a cable arranged on the inner side of a door, according to another embodiment of the present disclosure, FIG. 37 is a stepwise diagram illustrating a state of a camera module driven by an oven receiving information from a display module, according to an embodiment of the present disclosure, and FIG. 38 is a stepwise diagram illustrating a state of displaying an image of a material on a display module of an oven, according to another embodiment of the present disclosure.

Image information of the cooking room 20 of an oven 1' in accordance with another embodiment of the present disclosure may be displayed in the external device 1000 over the network 2000 as described above, or by the display module 60*a* as well.

Specifically, a micom 300*a* may send the image information to the external device 1000 and to the display module 60*a* in response to an input of control information from the user.

The display module 60*a* may include an image display 62 for displaying image information. The image display 62 may display image information generated by the monitoring unit 100, enabling the user to easily observe the cooking room 20 without need to hung his/her head down to look through the visible portion 42 provided on the door 40.

In the machine room 70, a display module controller 63 may be provided to control the display module 60*a*. The display module controller 63 may control the display module 60*a* to display the image information sent from the monitoring unit 100 on the display module 60*a*.

There may be a third cable 260 provided to electrically connect between the display module controller 63 and the monitoring unit 100. The third cable 260 enables the image information generated from the monitoring unit 100 to be sent to the display module controller 63 to display the image information on the image display 62.

One end of the third cable 260 may be connected to the display module controller 63, and the other end of the second cable 220 may be connected to the second cable 220 to be electrically connected to the micom 300*a* and the monitoring unit 100.

In other words, the third cable 260 may be separated at one end of the second cable 220, and the information sent on the second cable 220 may also be sent to the third cable 260.

Displaying image information of the inside of the cooking room 20 in the display module 60*a* will now be described in detail.

The user may enter monitoring control information to the display module 60*a*, in 700. The user may enter the control information by touching a display screen of the display module 60*a* or through a manipulation part (not shown) separately arranged in the display module 60*a*.

The control information may be sent to the micom 300*a* via the cable 200, in 710.

The micom 300*a* may first drive a lighting part according to the control information, in 720.

After the lighting part is driven and a certain period of time has passed, the micom 300*a* may control the monitoring unit 100 to be driven, in 730. The micom 300*a* may control the camera module 110 to take an image of the cooking room 20 in various modes according to the control information entered by the user.

The monitoring unit 100 may acquire image information through the camera module 110, and after completion of the driving, send the information about the driving to the micom 300*a*, in 800.

Upon reception of the information, the micom 300*a* may control the monitoring unit 100 to send the image information acquired by the monitoring unit 100 to the display module controller 63, in 810.

Accordingly, the image information may be sent from the monitoring unit 100 to the display module controller 63, in 820.

Upon reception of the image information, the display module controller 63 may drive the display module 60*a* to display the received information on the image display 62.

The micom 300*a* may be configured to send the image information to the external device 1000 over the network 2000 or to the display module controller 63 according to the received information.

Specifically, if control information is input from the external device 1000, the micom may perform a control function to drive the monitoring unit 100 to send the acquired information back to the external device 1000, and if control information is input from the display module 60*a*, the micom may perform a control function to drive the monitoring unit 100 to display the acquired information on the image display 62.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

The invention claimed is:

1. An oven comprising:
a case;
a cooking room provided inside the case;
a door provided to open or close the cooking room and separable from the case;
a monitoring unit provided on the door and configured to monitor the inside of the cooking room; and
a cable electrically connected to the monitoring unit, wherein the cable comprises:
a first cable connected to the monitoring unit at a first end of the first cable, and
a second cable detachably connected to a second end of the first cable,
wherein the first cable is provided to be separable from the second cable when the door is separated.

2. The oven of claim 1, wherein:
the first cable is arranged on an inner side of the door, and
the second cable is arranged on an inner side of the case.

3. The oven of claim 2, wherein the second end of the first cable extends down from the door to protrude down to an external side of the door.

4. The oven of claim 3, wherein the first cable and the second cable are coupled in a region located underneath the door.

5. The oven of claim 4, further comprising:
a storage room provided under the cooking room,
wherein the first cable and the second cable are coupled in a region corresponding to a height of the storage room.

6. The oven of claim 5, wherein:
the storage room is provided to slide against the case, and
the first cable and the second cable are separable while the storage room is slid open.

7. The oven of claim 5, wherein the first cable and the second cable are coupled in a region exposed to the outside of the oven when the storage room is opened.

8. The oven of claim 2, wherein the first end of the first cable bores through the door and is coupled to the monitoring unit.

9. The oven of claim 1, wherein:
the second end of the first cable has a first coupler to be detachably coupled to the second cable, and
a first end of the second cable has a second coupler to be detachably coupled to the first cable.

10. The oven of claim 1, further comprising:
a micom configured to control a camera unit,
wherein the cable electrically connects the micom and the monitoring unit.

11. The oven of claim 10, wherein a second end of the second cable is coupled to the micom.

12. The oven of claim 1, wherein:
the door comprises a visible portion made of a transparent material to view the cooking room when the door is closed, and
the monitoring unit is configured to monitor the cooking room through the visible portion.

13. The oven of claim 12, wherein the monitoring unit is located on an outer side of the visible portion.

14. The oven of claim 1, wherein the monitoring unit is configured to:
monitor the inside of the cooking room; and
send information resulting from the monitoring to an external device over a network.

* * * * *